US012139977B2

(12) United States Patent
Saunders et al.

(10) Patent No.: US 12,139,977 B2
(45) Date of Patent: Nov. 12, 2024

(54) PIPE SPEED SENSOR

(71) Applicant: National Oilwell Varco, L.P., Houston, TX (US)

(72) Inventors: Christopher J. Saunders, Houston, TX (US); Ayodele Odunfa-Jones, Houston, TX (US); Andrew I. McKenzie, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 488 days.

(21) Appl. No.: 17/430,660

(22) PCT Filed: Feb. 14, 2020

(86) PCT No.: PCT/US2020/018322

§ 371 (c)(1),
(2) Date: Aug. 12, 2021

(87) PCT Pub. No.: WO2020/168215

PCT Pub. Date: Aug. 20, 2020

(65) Prior Publication Data

US 2022/0145710 A1 May 12, 2022

Related U.S. Application Data

(60) Provisional application No. 62/805,411, filed on Feb. 14, 2019.

(51) Int. Cl.
*E21B 19/16* (2006.01)
*E21B 44/00* (2006.01)

(52) U.S. Cl.
CPC ..... *E21B 19/166* (2013.01); *E21B 44/00* (2013.01)

(58) Field of Classification Search
CPC ..... E21B 19/166; E21B 44/00; E21B 19/167; E21B 19/168; E21B 19/16
(Continued)

(56) References Cited

U.S. PATENT DOCUMENTS 4,512,216 A * 4/1985 Callegari, Sr. ..... E21B 19/168 81/57.17
8,240,371 B2 8/2012 Tepavac et al.
(Continued)

OTHER PUBLICATIONS

First Examination Report dated Sep. 27, 2023, for Saudi Application No. 521430071 and English summary.
(Continued)

*Primary Examiner* — Robert R Raevis
(74) *Attorney, Agent, or Firm* — Conley Rose, P.C.

(57) ABSTRACT

A drill pipe speed sensor includes a roller head assembly including an incremental encoder, a roller to contact a drill pipe, and first and second rotating members. The first rotating member is coupled to the roller, the second rotating member is coupled to the incremental encoder, and the first rotating member is coupled to the second rotating member. The sensor also includes a pivot assembly having mounting plates, pivotal arms, first and second mounting members, and a biasing member. The first and second mounting members extend between the mounting plates, which are parallel to each other. The biasing member contacts the mounting members and extends between the mounting members, and the biasing member is parallel to the mounting plates. The pivotal arms extend from the mounting plates to the roller head assembly and pivot relative to the mounting plates, and the first mounting member is coupled to two pivotal arms.

25 Claims, 16 Drawing Sheets

(58) Field of Classification Search
USPC ..... 73/204.22, 152.01, 488, 493, 494; 166/250.01, 377–380; 175/40, 162, 85
See application file for complete search history.

(56) References Cited

U.S. PATENT DOCUMENTS

| | | | | |
|---|---|---|---|---|
| 9,952,119 | B2 | 4/2018 | Simanjuntak et al. | |
| 2005/0034565 | A1 | 2/2005 | Drzewiecki | |
| 2009/0211405 | A1 | 8/2009 | Hunter et al. | |
| 2012/0160517 | A1 | 6/2012 | Bouligny et al. | |
| 2013/0298734 | A1 | 11/2013 | Hunter | |
| 2014/0338973 | A1 | 11/2014 | Taylor et al. | |
| 2015/0308253 | A1* | 10/2015 | Clark | E21B 33/02 175/24 |
| 2016/0290075 | A1 | 10/2016 | Hunter | |
| 2018/0216423 | A1 | 8/2018 | Henriksen et al. | |

OTHER PUBLICATIONS

International Search Report and Written Opinion dated May 8, 2020, for Application No. PCT/US2020/018322.

* cited by examiner

PIPE SPEED SENSOR

CROSS-REFERENCE TO RELATED APPLICATIONS

The present application is a 35 U.S.C. § 371 national stage application of PCT/US2020/018322 filed Feb. 14, 2020, and entitled "Pipe Speed Sensor" which claims benefit of U.S. provisional patent application No. 62/805,411 filed on Feb. 14, 2019, and entitled "Pipe Speed Sensor," both of which are incorporated herein by reference in their entirety.

BACKGROUND

In the oil and gas industry, drill pipes include threaded ends to allow a connection or a disconnection between two drill pipes. Each drill pipe includes two threaded ends or tool joints: a threaded pin on one end and a threaded box on the opposite end. During a connection/disconnection, two drill pipes are coaxially aligned (e.g., a top drill pipe positioned above a bottom drill pipe) and a piece of oilfield machinery, such as an iron roughneck, clamps the bottom drill pipe, while spinning or rotary wrenches rotate the top drill pipe to mate a threaded end of the top drill pipe to a threaded end of the bottom drill pipe. This allows the makeup or breakdown of a drill string.

SUMMARY

In an embodiment, a drill pipe speed sensor includes a roller head assembly including an incremental encoder, a roller to contact a drill pipe, and first and second rotating members. The first rotating member is coupled to the roller, the second rotating member is coupled to the incremental encoder, and the first rotating member is coupled to the second rotating member. The sensor also includes a pivot assembly having mounting plates, pivotal arms, first and second mounting members, and a biasing member. The first and second mounting members extend between the mounting plates, which are parallel to each other. The biasing member contacts the mounting members and extends between the mounting members, and the biasing member is parallel to the mounting plates. The pivotal arms extend from the mounting plates to the roller head assembly and pivot relative to the mounting plates, and the first mounting member is coupled to two pivotal arms.

In an embodiment, a drill pipe speed sensor includes a roller head assembly including an incremental encoder, a first rotating member, a second rotating member, and a roller configured to contact a drill pipe of a drill string during rotation of the drill pipe. The drill string comprises a plurality of drill pipes with different outer diameters. The first rotating member is coupled to the roller, the second rotating member is coupled to the incremental encoder, and the first rotating member is coupled to the second rotating member. The drill pipe speed sensor also includes a pivot assembly comprising mounting plates, pivotal arms, a first mounting member, a second mounting member, and a biasing member. The first and second mounting members extend between the mounting plates, and the mounting plates are parallel to each other. The biasing member contacts the mounting members and extends between the mounting members, and the biasing member is parallel to the mounting plates. The pivotal arms extend from the mounting plates to the roller head assembly and pivot relative to the mounting plates, and the first mounting member is coupled to two pivotal arms. The biasing member is configured to move the roller head assembly in a forward or rearward direction to allow contact between each of the drill pipes with different outer diameters and the roller. The incremental encoder is configured to determine rotational speed and direction of the roller and transmit the rotational speed and direction to a system controller of a spinning wrench carrier.

In an embodiment, a method for determining a rotational speed and direction of a drill pipe includes positioning a drill pipe speed sensor adjacent to a drill pipe. The drill pipe speed sensor includes a roller head assembly including an incremental encoder, a roller, a first rotating member and a second rotating member. The first rotating member is coupled to the roller, the second rotating member is coupled to the incremental encoder, and the first rotating member is coupled to the second rotating member. The drill pipe speed sensor also includes a pivot assembly comprising mounting plates, pivotal arms, a first mounting member, a second mounting member, and a biasing member. The first and second mounting members extend between the mounting plates, the mounting plates are parallel to each other, and two pivotal arms are attached to the roller head assembly and the first mounting member. The biasing member contacts the mounting members and extends between the mounting members, and the biasing member is parallel to the mounting plates. The method further includes expanding or compressing the biasing member to move the first mounting member, the pivotal arms, and the roller head assembly, forward or backward; contacting the drill pipe with the roller; rotating the roller with the drill pipe, where the drill pipe is rotating due to spinning wrenches of a spinning wrench carrier; and measuring, with the incremental encoder, a rotational speed and direction of the roller to provide the rotational speed and direction of the drill pipe.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION OF DISCLOSED EXEMPLARY EMBODIMENTS

Figure 1C:
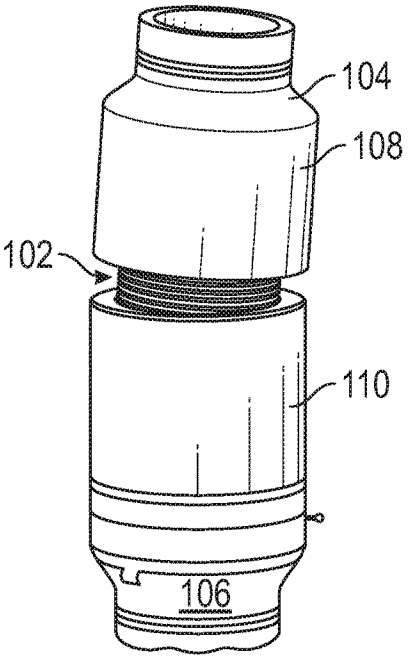
FIG. 1*c* illustrates a "cross-threaded" status in accordance with an embodiment of the disclosure.

The present subject matter will now be described with reference to the attached figures. Various structures and methods are schematically depicted in the figures for purposes of explanation only and so as to not obscure the present disclosure with details that are well known to those skilled in the art. Nevertheless, the attached figures are included to describe and explain illustrative examples of the present disclosure. The words and phrases used herein should be understood and interpreted to have a meaning consistent with the understanding of those words and phrases by those skilled in the relevant art. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

In the following detailed description, various details may be set forth in order to provide a thorough understanding of the various exemplary embodiments disclosed herein. However, it will be clear to one skilled in the art that some illustrative embodiments may be practiced without some of the various disclosed details. Furthermore, features and/or processes that are well-known in the art may not be described in full detail so as not to unnecessarily obscure the disclosed subject matter.

Currently, in the oil and gas industry, spinning wrenches, for example of an iron roughneck, do not determine the effectiveness of torque transmission from the spinning wrenches to a drill pipe. For example, if the spinning wrenches stalled or slipped on a drill pipe during a connection (or disconnection), it could mean the drill pipe is shouldered, or cross-threaded and therefore stuck. Current industry technology does not identify a successful drill pipe connection or a fault, due to a lack of sensors that directly identify status of the drill pipe connection.

The present disclosure relates generally to a drill pipe speed sensor for detecting a rotational speed and direction of a first drill pipe that is being connected/disconnected to/from a second drill pipe via spinning wrenches, which in some cases are integrated or coupled to an iron roughneck. The rotational speed and direction (e.g., clockwise or counter-clockwise) may be transmitted to a system controller of the spinning wrenches and may be utilized to determine a status of the connection. The status of the drill pipe connection may include: (1) "shouldered": a shoulder of the first drill pipe has contacted a shoulder of the second drill pipe (this may indicate that the first drill pipe has been properly secured/connected to the second drill pipe); and (2) "cross-threaded": threads of the first drill pipe are cross-threaded with threads of the second drill pipe (this may indicate that the first drill pipe is stuck and has not been properly connected to the second drill pipe). Upon receipt of the rotational speed and direction, the system controller of the spinning wrenches may determine the status based on the rotational speed and direction, and notify an operator of the spinning wrenches (or an iron roughneck that includes such spinning wrenches) of the status. Based on the status, the operator may choose to stop the spinning wrenches from rotating the first drill pipe, thereby preventing or reducing damage to the drill pipes. For example, the threads of both drill pipes may be damaged if a shouldered connection is overtightened, or if the spinning wrenches continue to rotate the first drill pipe that is cross-threaded with the second drill pipe.

Another aspect of the disclosure is that the drill pipe sensor may be mounted directly to a carrier for the spinning wrenches and may interface with a range of drill pipe outer diameters, (e.g., 2⅞ inches through 9½ inches) without component modification or substitution. In some examples, the carrier for the spinning wrenches includes an iron roughneck, while in other examples, the carrier for the spinning wrenches includes a pipe column racker. Regardless of the specific implementation of the carrier for the spinning wrenches, the drill pipe speed sensor disclosed herein allows for a faster determination of the statuses of drill pipes with different outer diameters, as compared to modifying/substituting components of the drill pipe sensor to accommodate (and determine rotational speed and direction of) each different drill pipe outer diameter.

Additionally, the drill pipe sensor disclosed herein may also be used to measure rotational speed and direction of other downhole/drilling tubulars (e.g., downhole logging tools/instruments, drill collars) in addition to drill pipes.

Figure 1B:
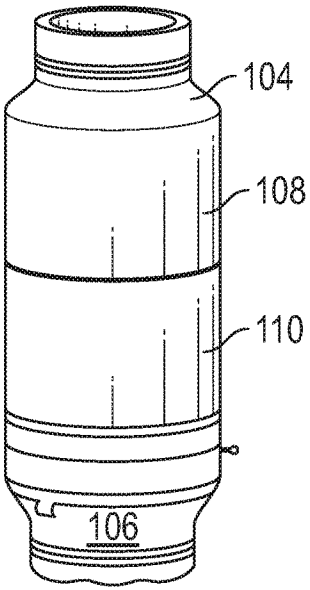
FIG. 1*b* illustrates a "shouldered" status in accordance with an embodiment of the disclosure.
Figure 1A:
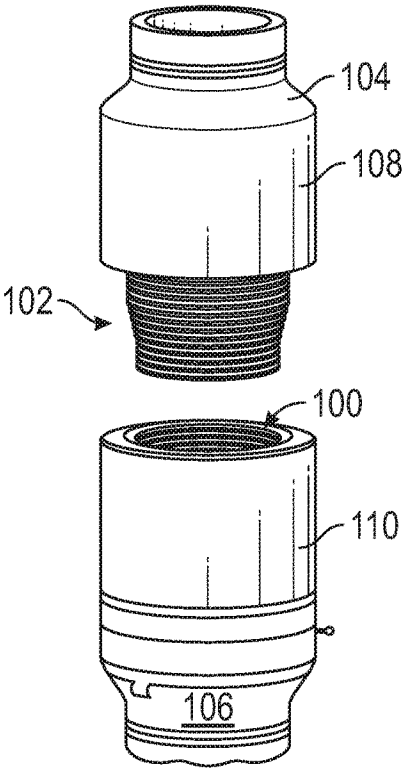
FIG. 1*a* illustrates threaded ends of a drill pipe in accordance with an embodiment of the disclosure.

Referring now to FIG. 1*a*, threaded ends 100 (box) and 102 (pin) of drill pipes 104 and 106, respectively, are shown. Drill pipes 104 and 106 include shoulders 108 and 110, respectively. FIG. 1*b* illustrates a "shouldered" status. As shown, shoulders 108 and 110 are in contact with each other. This indicates a proper connection between drill pipe 104 and drill pipe 106. In contrast, FIG. 1*c* illustrates a "cross-threaded" status (an improper connection). As shown, threaded end 102 has been cross-threaded with threaded end 100. This cross-threading causes threaded end 102 to be stuck in drill pipe 106 (i.e., threaded end 100, shown in FIG. 1*a*). As shown, this cross-threading prevents a "shouldered" status.

Figure 2A:
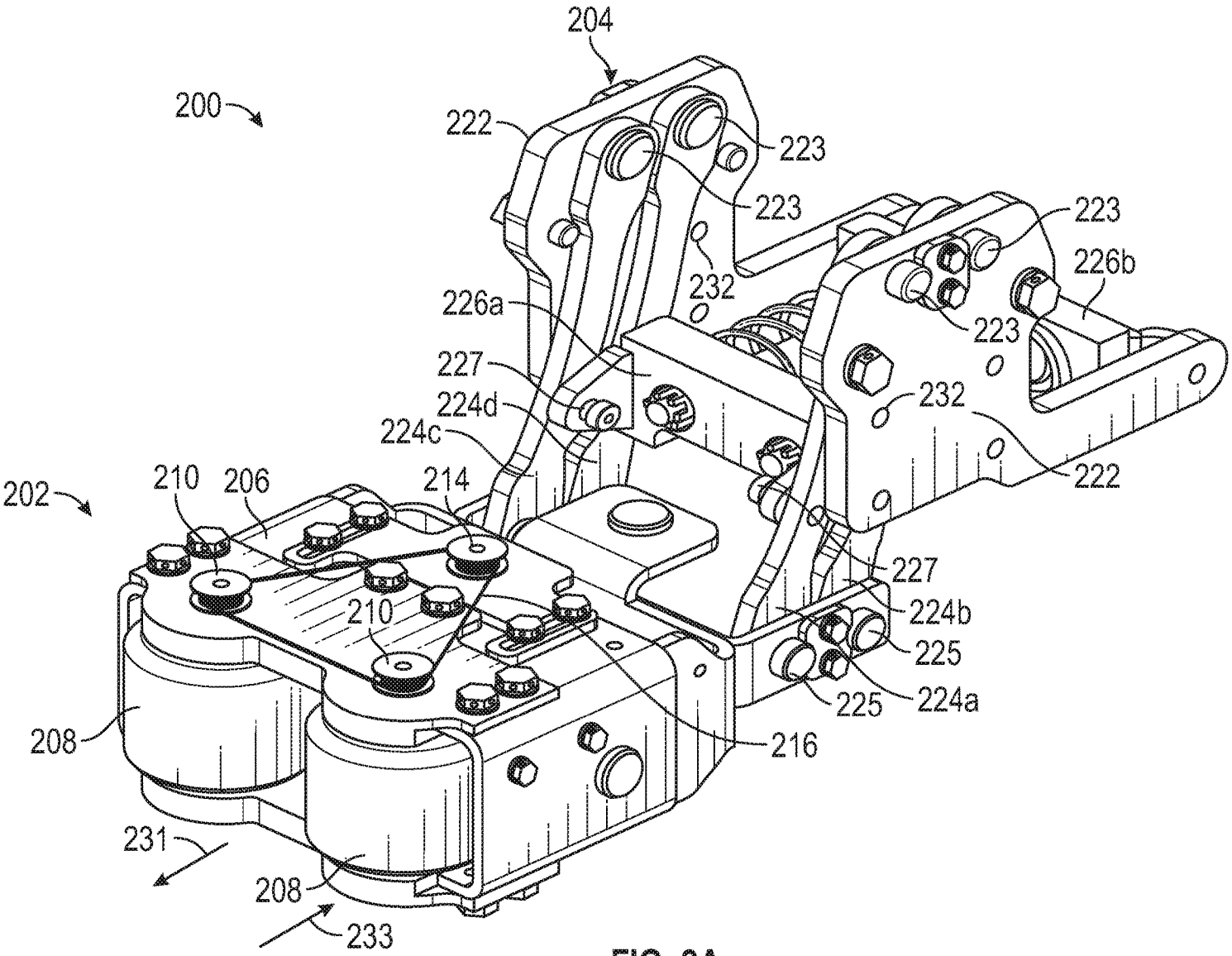
FIG. 2*a* is a front perspective view of a spring actuated drill pipe sensor in accordance with an embodiment of the disclosure.
Figure 2B:
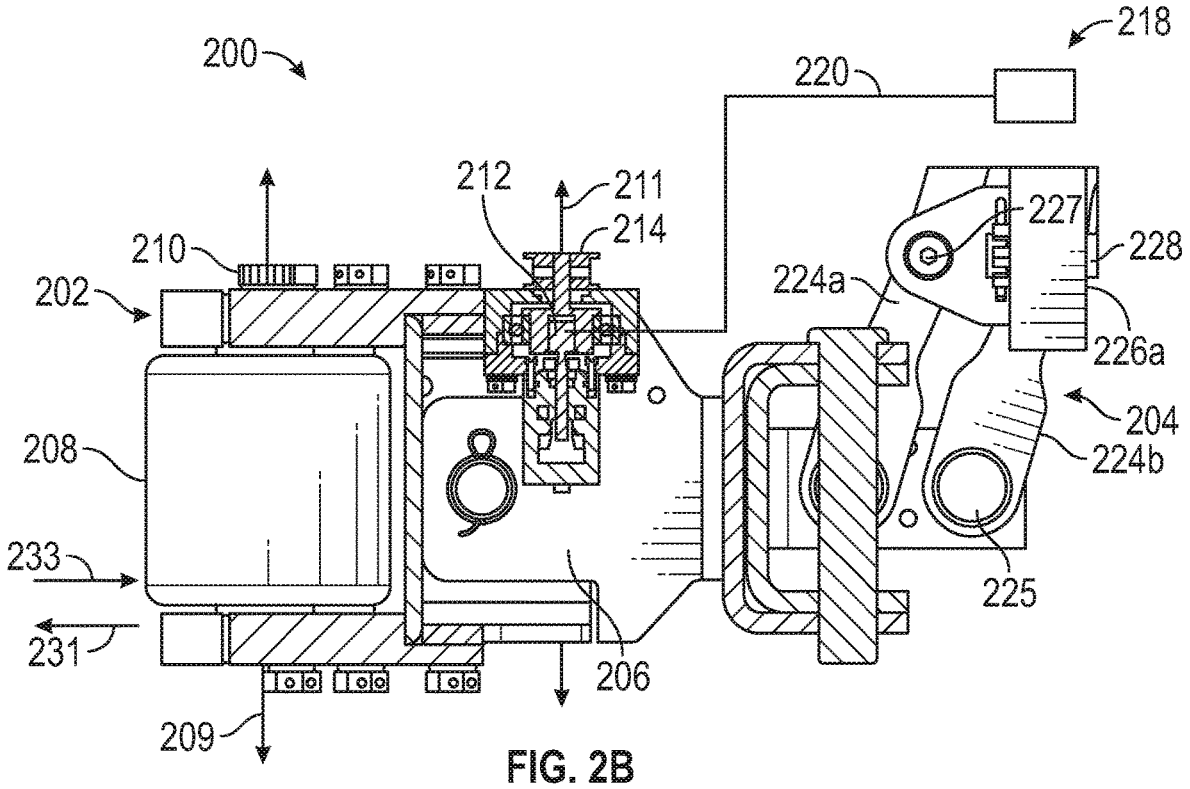
FIG. 2*b* is a side view of the spring actuated drill pipe speed sensor in accordance with an embodiment of the disclosure.
Figure 2C:
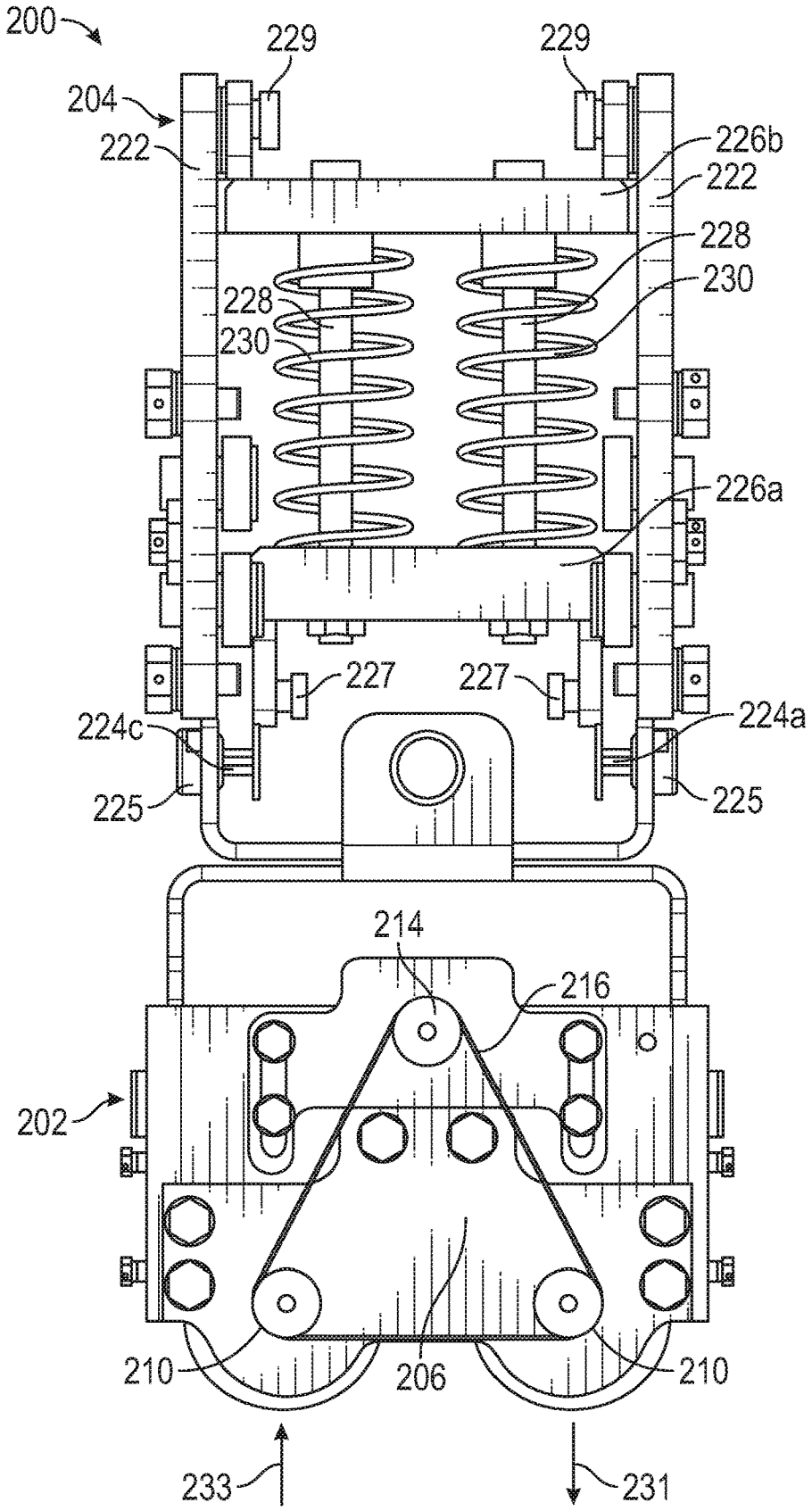
FIG. 2*c* is a top view of the spring actuated drill pipe speed sensor in accordance with an embodiment of the disclosure.

FIGS. 2*a*-2*c* illustrate a spring actuated drill pipe speed sensor 200 including roller head assembly 202 and pivot assembly 204.

Roller head assembly 202 includes housing 206 that includes at least one roller 208 (e.g., two rollers 208, as shown). Rollers 208 may be positioned adjacent to one another and may protrude from housing 206 in order to contact a drill pipe. Rollers 208 rotate about/around vertical axis 209 (e.g., a rod, a rigid member), as shown in FIG. 2*b*. Rollers 208 are configured to contact a drill pipe and rotate along with a rotating drill pipe (i.e., the rotating drill pipe causes rotation of the rollers 208). Each roller 208 is coupled to a rotating member 210 (e.g., a cogged pulley or a gear).

As shown, each rotating member 210 is positioned above a roller 208 and extends through housing 206 to a roller 208. Rotating members 210 rotate along with rollers 208 (i.e., the rotating drill pipe causes rotation of the rollers 208 which causes rotation of the rotating members 210). Housing 206 may also include an incremental encoder 212 (shown in FIG. 2*b*) coupled to rotating member 214 (e.g., a cogged pulley or a gear). As shown, rotating member 214 is positioned above incremental encoder 212 and extends through housing 206 to incremental encoder 212.

Incremental coder 212 rotates about/around vertical axis 211 (e.g., a rod, a rigid member), as shown in FIG. 2*b*. Rotating members 210 and 214 are bound/coupled by a motion transfer member 216 (e.g., line, cable, wire, chain, belt (e.g., cogged belt)). Incremental encoder 212 measures the speed (e.g., rotations per minute, "RPM") and direction (e.g., clockwise or counterclockwise) of rollers 208. Incremental coder 212 may be hard wired (via line 220) to system controller 218 of a spinning wrench, or a set of spinning wrenches (e.g., coupled to a spinning wrench carrier 602 as part of a spinning wrench assembly 600, shown in FIG. 6) and is configured to transmit (via line 220) a measured direction and RPM of rollers 208 to system controller 218 of a spinning wrench, as shown in FIG. 2*b*. Also, system controller 218 may supply power to incremental encoder 212 via line 220. System controller 218 may include a computer system including any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. System controller 218 may include random access memory ("RAM"), one or more processing resources such as a central processing unit ("CPU") or hardware or software control logic, read-only memory ("ROM"), and/or other types of nonvolatile memory. Additional components of system controller 218 may include one or more disk drives, one or more network ports for communication with external devices as well as various input and output (I/O) devices, such as a keyboard, a mouse, and a video display. System controller 218 also may include one or more buses operable to transmit communications between the various hardware components.

System controller 218 may also include computer-readable media. Computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory ("EEPROM"), and/or flash memory; as well as communications media such as wires, optical fibers, microwaves, radio waves, and other electromagnetic and/or optical carriers; and/or any combination of the foregoing.

Figure 6:
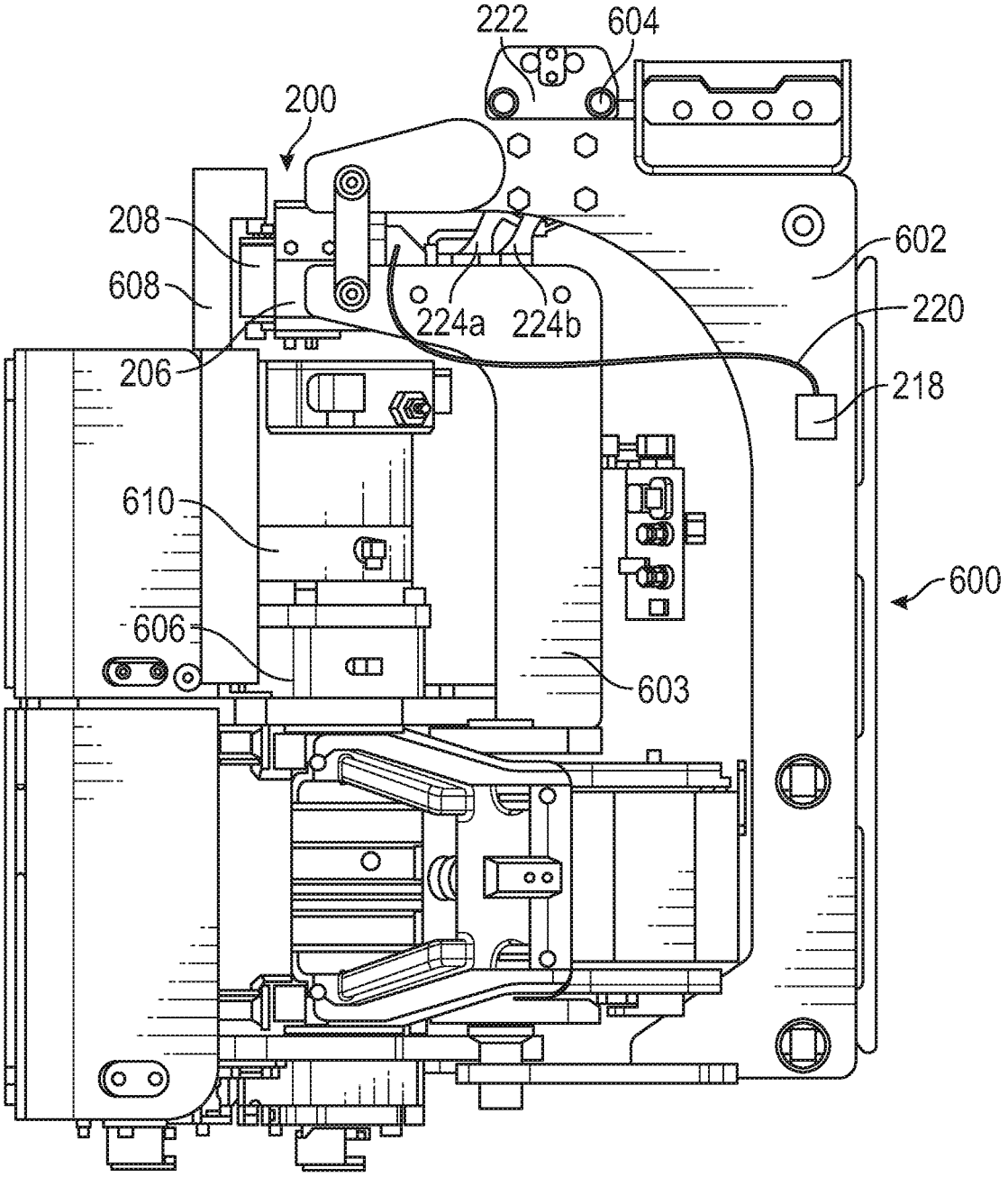
FIG. 6 is a side view of a drill pipe speed sensor attached to a spinning wrench, in accordance with an embodiment of the disclosure.

Pivot assembly 204 may include mounting plates 222; pivotal arms 224*a*, 224*b*, 224*c*, 224*d*; spring cups 226*a*, 226*b*; alignment rods 228; and compression springs 230. Mounting plates 222 are configured to attach to a spinning wrench frame 603 or a spinning wrench carrier 602 of the spinning wrench assembly 600 via attachment members 604 (e.g., bolts, screws, or rods), as shown in FIG. 6. Mounting plates 222 include mounting holes 232 (e.g., four mounting holes 232 on each mounting plate 222, as shown). Mounting plates 222 may be positioned parallel to each other.

Pivotal arms 224*a*, 224*b*, 224*c*, and 224*d* attach to roller head assembly 202 via attachment members 225 (e.g., bolts, screws, or rods). Pivotal arms 224*a*, 224*b*, 224*c*, and 224*d* are attached to mounting plates 222 via attachment members 223 (e.g., bolts, screws, or rods). Pivotal arms 224*a*, 224*b*, 224*c*, and 224*d* are configured to move roller head assembly 202 in a forward direction 231 or a rearward direction 233 by pivoting relative to mounting plates 222. In other words, attachment members 223 are pivot points that allow pivotal arms 224*a*, 224*b*, 224*c*, and 224*d* to swing forward or backward thereby moving roller head assembly 202 forward or backward.

Spring cups 226*a* and 226*b* may extend between mounting plates 222 orthogonally, for example, as shown in FIG. 2*c*. Spring cups 226*a* and 226*b* may be parallel to each other. Spring cup 226*a* may be coupled to pivotal arms 224*a* and 224*c* via attachment members 227 (e.g., bolts, screws, or rods). Spring cup 226*a* may be configured to move in a forward direction 231 or a rearward direction 233 along with roller head assembly 202 and pivotal arms 224*a*, 224*b*, 224*c*, and 224*d*. Spring cup 226*b* may be coupled to mounting plates 222, via attachment members 229 (e.g., bolts, screws, or rods), as shown in FIG. 2*c*. Spring cup 226*b* remains stationary, as opposed to spring cup 226*a* which moves forward or backward.

Alignment rods 228 are configured to align spring cup 226*a* with spring cup 226*b*. Alignment rods 228 are coupled to spring cup 226*a* and movably positioned within spring cup 226*b*, as shown in FIG. 2*c*. In other words, as roller head assembly 202, pivotal arms 224*a*, 224*b*, 224*c*, and 224*d*, and spring cup 226*a* move in unison (e.g., forward direction 231 or rearward direction 233), alignment rods 228 also move in unison with roller head assembly 202, pivotal arms 224*a*, 224*b*, 224*c*, and 224*d*, and spring cup 226*a* (e.g., forward or backward, through spring cup 226*b*).

Figure 4:
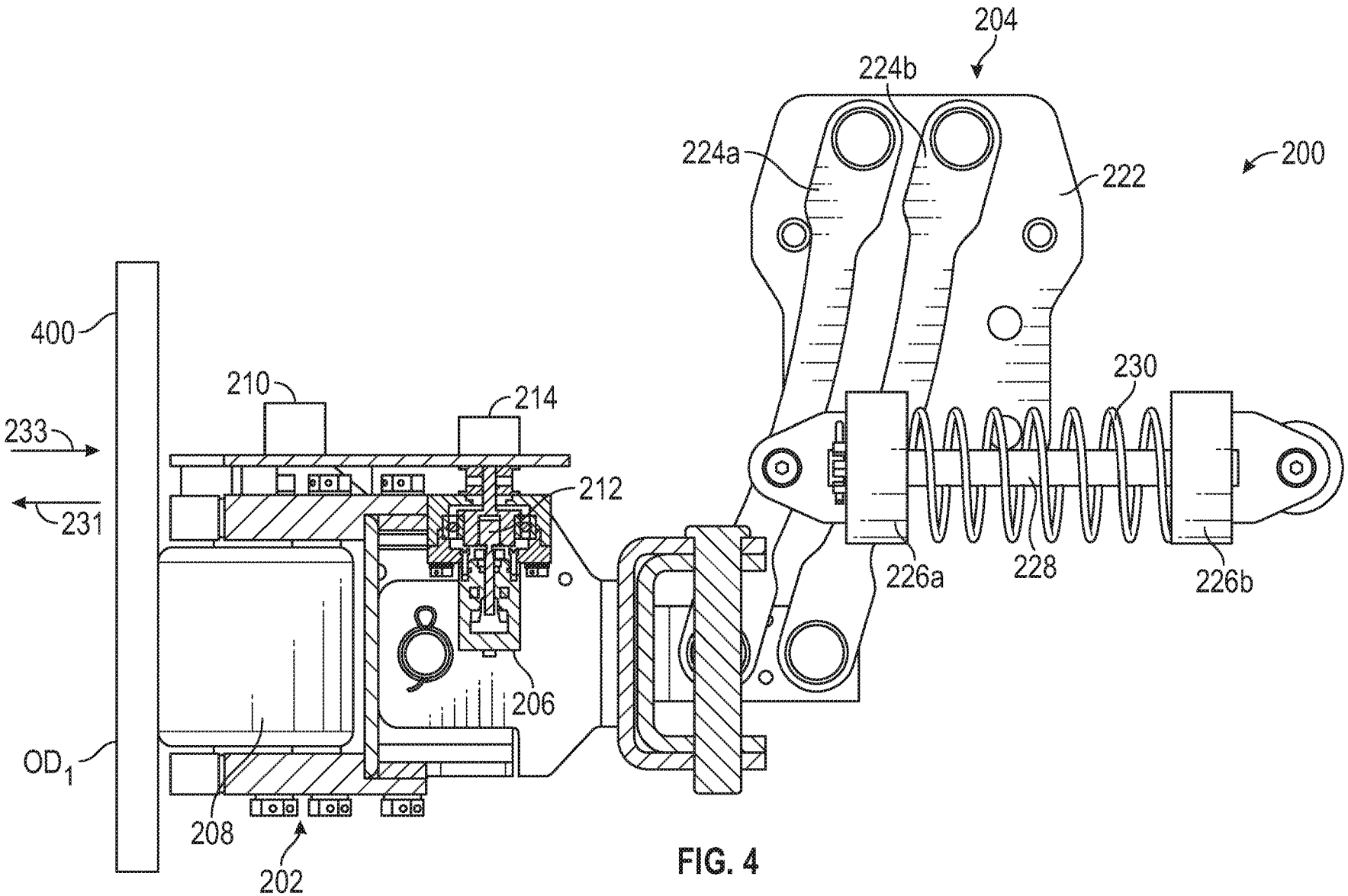
FIG. 4 is a side view of the spring actuated drill pipe speed sensor with expanded springs in accordance with an embodiment of the disclosure.
Figure 5:
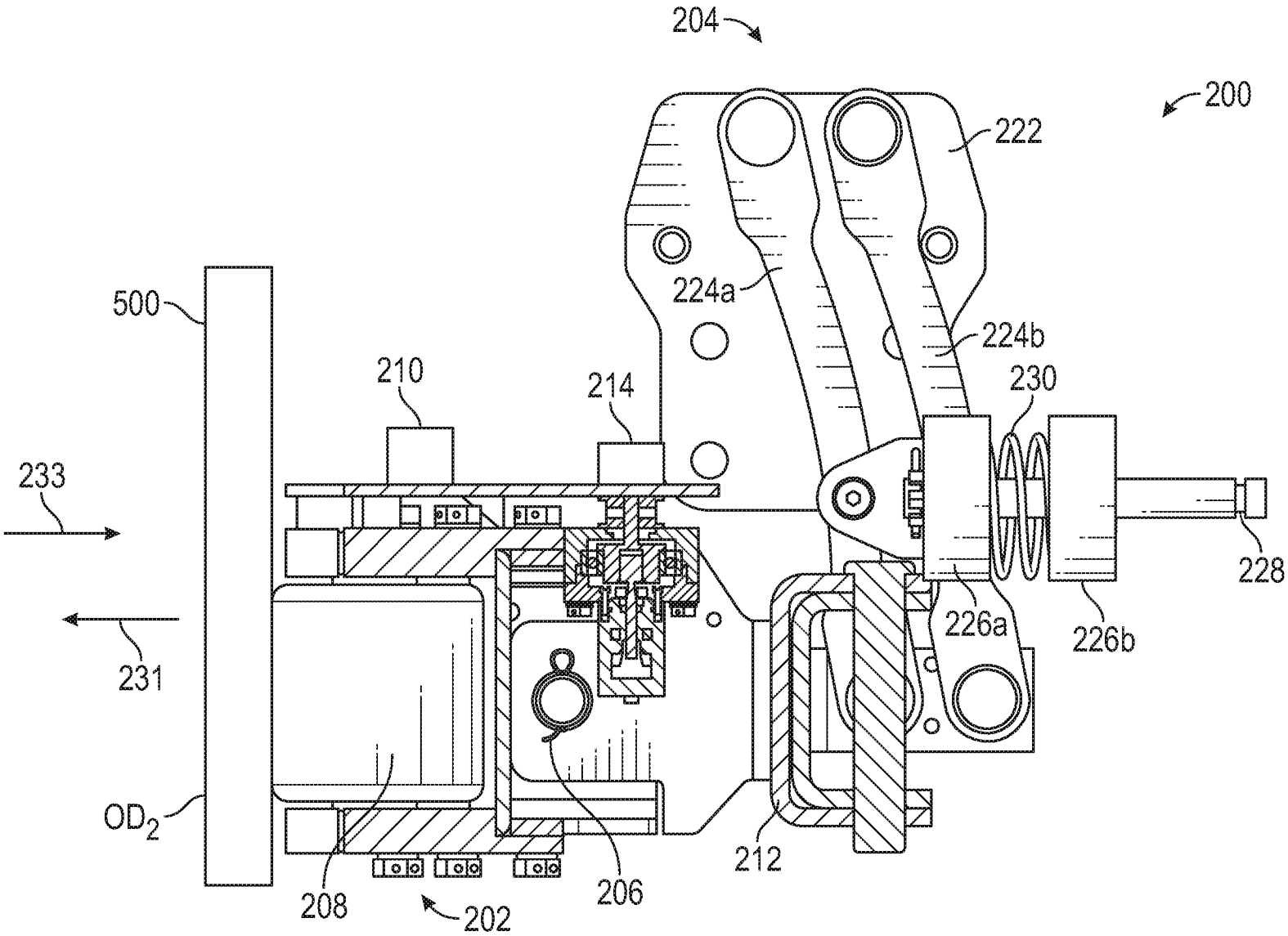
FIG. 5 is a side view of the spring actuated drill pipe speed sensor with compressed springs in accordance with an embodiment of the disclosure.

Compression springs 230 are in contact with spring cups 226*a*, 226*b*, and extend between spring cups 226*a* and 226*b*. Alignment rods 228 may extend through compression springs 230, as shown in FIG. 2*c*. When compression springs 230 are in an expanded position, as shown in FIG. 4, roller head assembly 202, pivotal arms 224*a*, 224*b*, 224*c*, and 224*d*, spring cup 226*a*, and alignment rods 228 are in a forward position (to contact/accommodate a smaller outer diameter, OD, (e.g., 2¾ inch OD) drill pipe with rollers 208 of roller head assembly 202). When compression springs 230 are in a compressed position, as shown in FIG. 5, roller head assembly 202, pivotal arms 224*a*, 224*b*, 224*c*, and 224*d*, spring cup 226*a*, and alignment rods 228 are in a rearward position (to contact/accommodate a larger diameter (e.g., 6⅝ inch OD) drill pipe with rollers 208 of roller head assembly 202). In other words, as the OD increases, roller head assembly 202, pivotal arms 224, spring cup 226*a*, and alignment rods 228 move further in the rearward direction; and as the OD decreases, roller head assembly 202, pivotal arms 224*a*, 224*b*, 224*c*, and 224*d*, spring cup 226*a*, and alignment rods 228 move in a forward direction. This allows drill pipe speed sensor 200 to measure RPM and direction of different OD drill pipes without component modification or substitution. ODs may range from 2¾ inches to 9½ inches, for example.

Figure 3A:
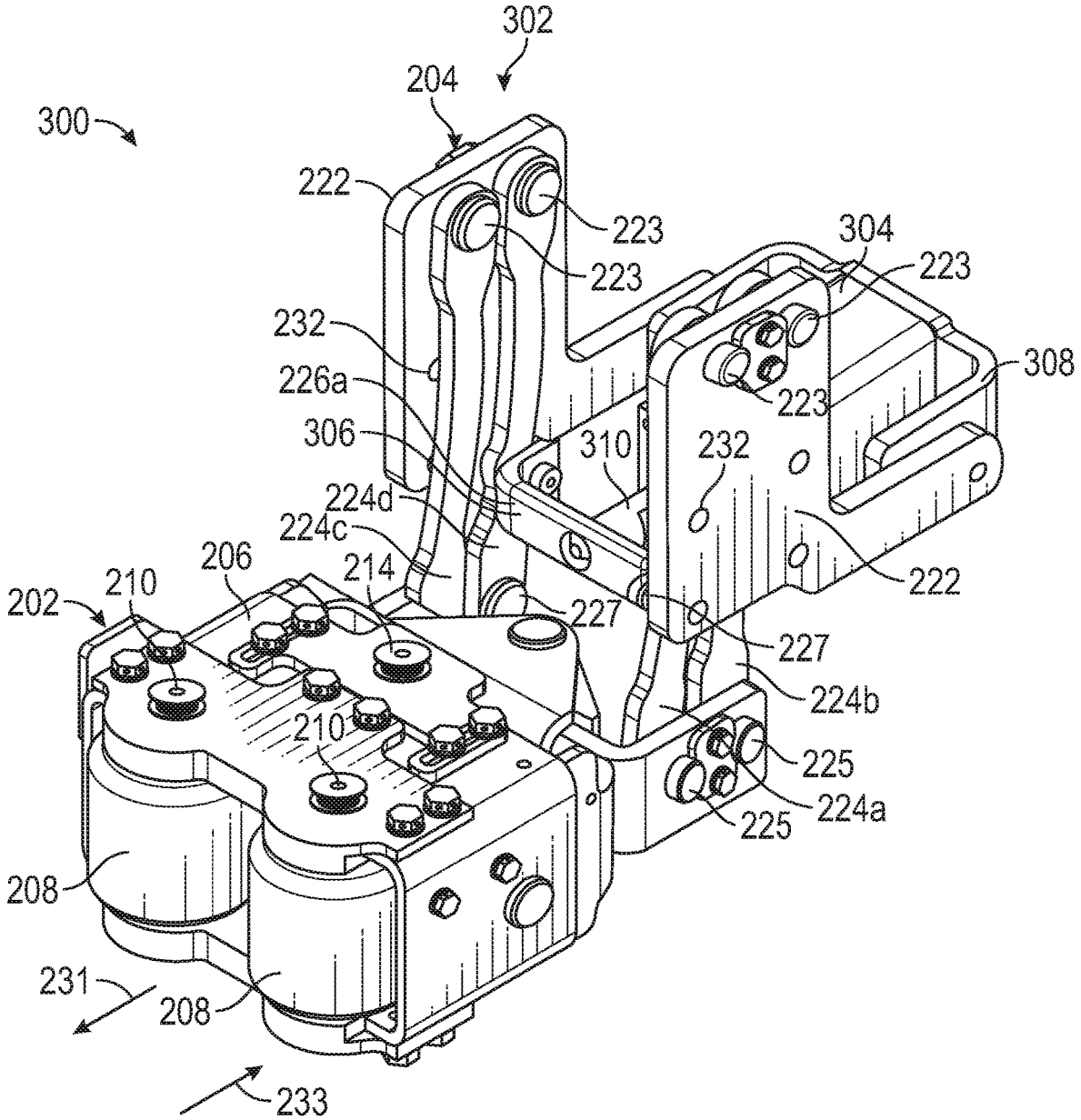
FIG. 3*a* is a front perspective view of a hydraulically actuated drill pipe speed sensor in accordance with an embodiment of the disclosure.
Figure 3B:
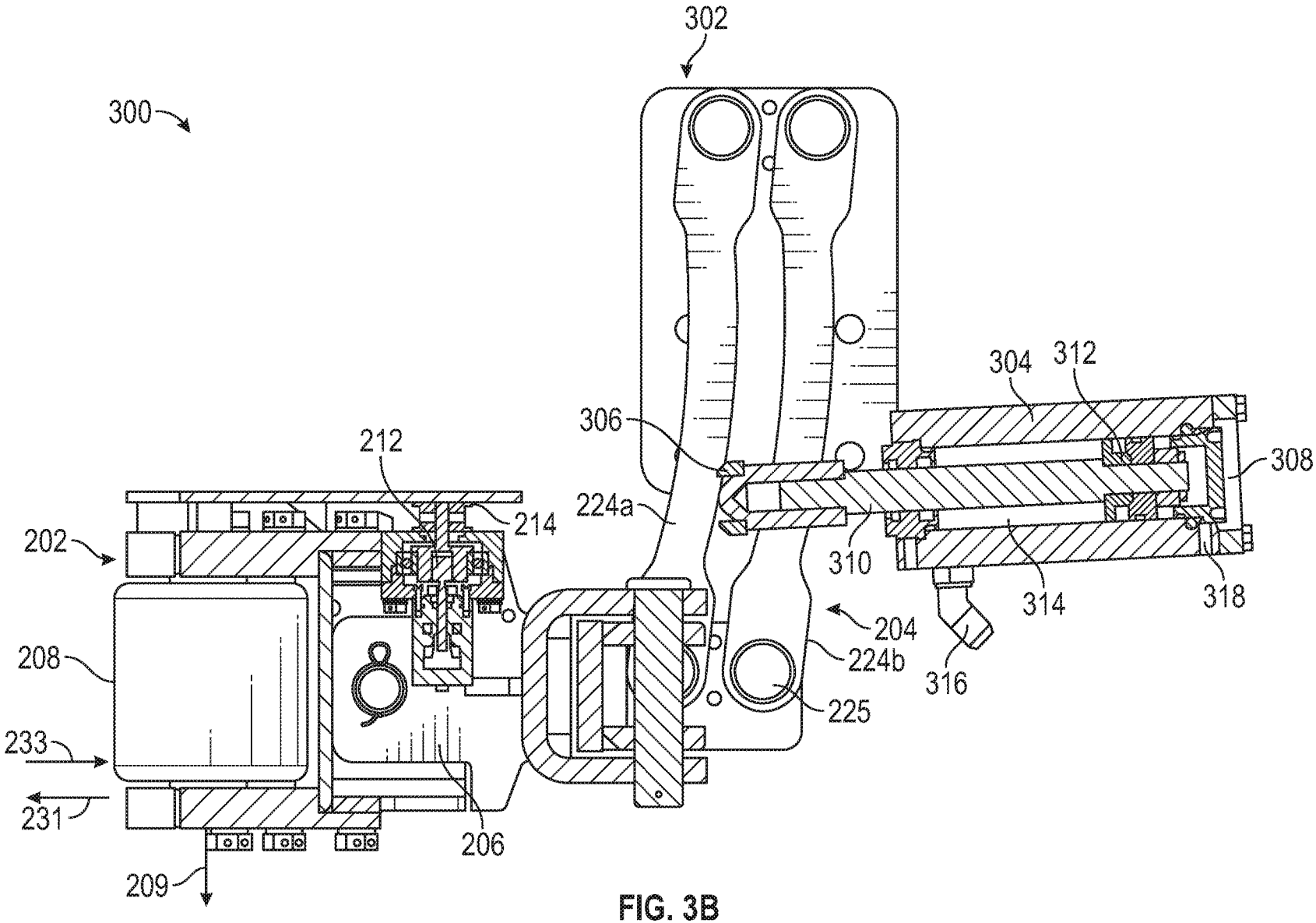
FIG. 3*b* is a side view of the hydraulically actuated drill pipe speed sensor in accordance with an embodiment of the disclosure.
Figure 3C:
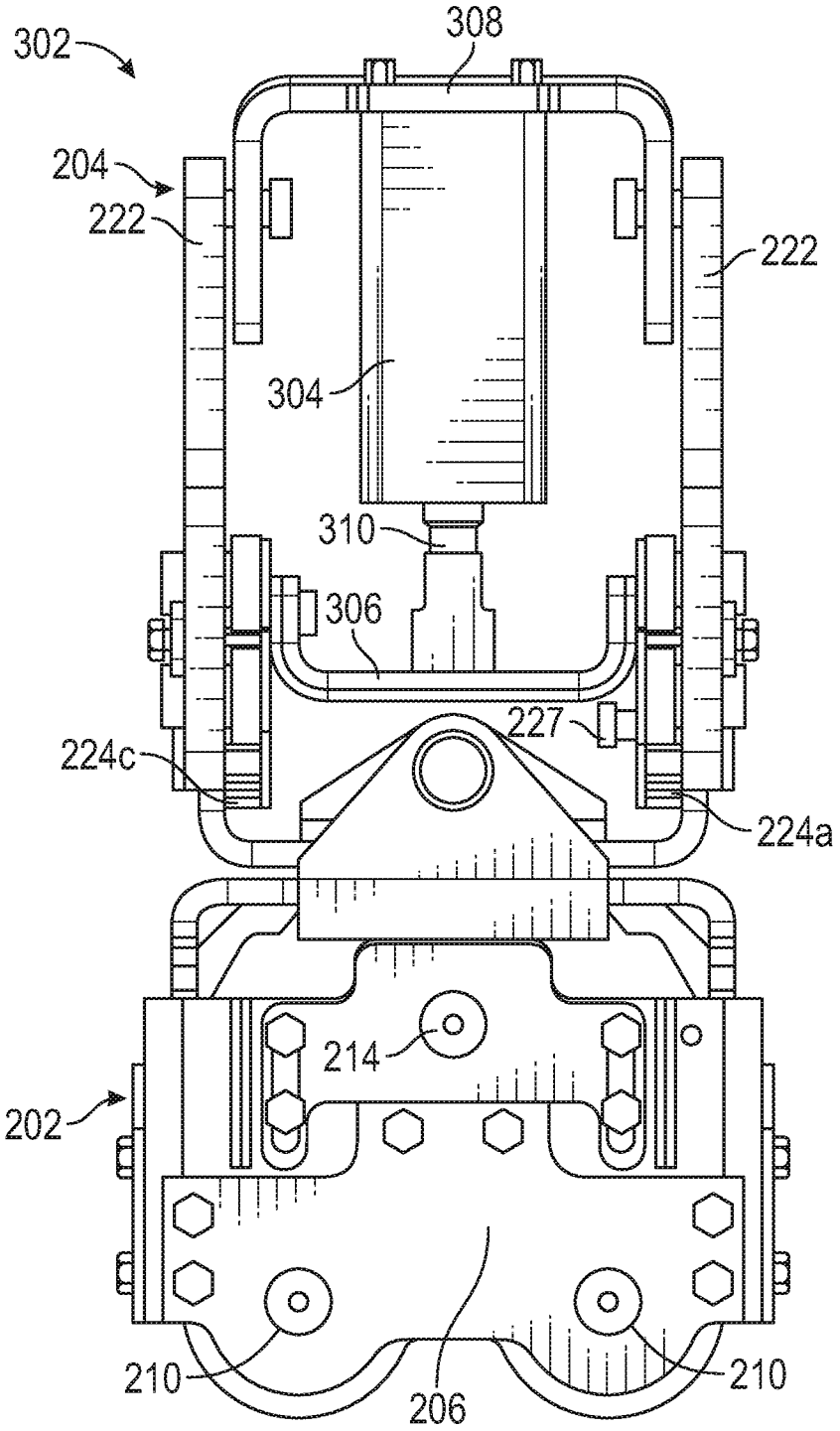
FIG. 3*c* is a top view of the hydraulically actuated drill pipe speed sensor in accordance with an embodiment of the disclosure.

FIGS. 3*a*-3*c* illustrate another drill pipe speed sensor 300, which in these examples is a hydraulically actuated drill pipe speed sensor 300. Various components in FIGS. 3*a*-3*c* are the same or substantially similar to components described above with respect to FIGS. 2*a*-2*c* and bear the same reference numerals described above in order to reflect this similarity. For example, the roller head assembly 202, the housing 206, the rollers 208, the rotating member 210, the incremental encoder 212, the rotating member 214, the motion transfer member 216, the system controller 218, the line 220, the mounting plates 222, the pivotal arms 224*a*-224*d*, the mounting holes 232, and various axes and attachment members are labeled in a like manner, and are substantially similar (e.g., both structurally and functionally) to those elements described above with respect to FIGS. 2*a*-2*c*.

The drill pipe speed sensor 200 includes roller head assembly 202 as described above, and a pivot head assembly 302, which is hydraulically actuated and thus differs from the pivot head assembly 204 described above, which is instead spring actuated. The pivot assembly 302 includes mounting plates 222 and pivotal arms 224*a*, 224*b*, 224*c*, 224*d*, as described above. In addition, the pivot assembly 302 includes a hydraulic cylinder 304, a cylinder clevis 306, a cylinder mount 308, and a piston 310 as shown in FIG. 3*a*.

The cylinder clevis 306 and the cylinder mount 308 may extend between mounting plates 222 orthogonally, for example, as shown in FIG. 3*c*. The cylinder clevis 306 and the cylinder mount 308 may be parallel to each other. The cylinder clevis 306 may be configured to move in a forward direction 231 or a rearward direction 233 along with the roller head assembly 202 and pivotal arms 224*a*, 224*b*, 224*c*, and 224*d*. The cylinder mount 308 may be coupled to mounting plates 222, via attachment members 229 (e.g., bolts, screws, or rods), as shown in FIG. 2*c*. The cylinder mount 308 remains stationary, as opposed to the cylinder clevis 306, which moves forward or backward.

The cylinder 304 is coupled to the cylinder mount 308, for example by bolts, screws, rods, or other attachment members. Similarly, the piston 310 is coupled to the cylinder clevis 306, for example by bolts, screws, rods, or other attachment members. As shown in FIG. 3*b*, the piston 310 is coupled to a piston head 312, which is configured to move within a cylinder chamber 314 of the cylinder 304 in response to a pressure differential across the piston head 312. A hydraulic port 316 is coupled to the cylinder chamber 314 of the cylinder 304 on a first side of the piston head 312, and is configured to facilitate the flow of a hydraulic into and out of the cylinder chamber 314 to control the position of the roller head assembly 202. Additionally, a pressurized gas port 318 is coupled to the cylinder chamber 314 on a second side of the piston head 312, and is configured to couple a source of pressurized gas (e.g., nitrogen) to the second side of the piston head 312.

In an example, adding hydraulic fluid into the cylinder chamber 314 via the hydraulic port 316 biases the piston head 312 to the right in FIG. 3*b*, which moves the piston 310 into a compressed position (e.g., similar to the position shown in FIG. 5), in which the roller head assembly 202, pivotal arms 224*a*, 224*b*, 224*c*, and 224*d*, and cylinder clevis 306 (rather than spring cup 226*a*), are in a rearward position (to contact/accommodate a larger diameter (e.g., 6⅝ inch OD) drill pipe with rollers 208 of roller head assembly 202). Continuing this example, removing hydraulic fluid from the cylinder chamber 314 via the hydraulic port 316 allows the pressurized gas (supplied by the pressurized gas port 318) to bias the piston head 312 to the left in FIG. 3*b*, which moves the piston 310 into an expanded position (e.g., similar to the position shown in FIG. 4), in which the, roller head assembly 202, pivotal arms 224*a*, 224*b*, 224*c*, and 224*d*, and cylinder clevis 306 (rather than spring cup 226*a*) are in a forward position (to contact/accommodate a smaller outer diameter, OD, (e.g., 2¾ inch OD) drill pipe with rollers 208 of roller head assembly 202). Additionally, when hydraulic fluid is removed from the cylinder chamber 314 and the rollers 208 contact a drill pipe, the pressurized gas supplied by the pressurized gas port 318, along with the cylinder 304 and the piston 310, acts as a gas spring to provide pressure to the rollers 208, for example so the rollers 208 remain in contact with the drill pipe as it rotates.

In the examples of FIGS. 3*a*-3*c*, in which the pivot head assembly 302 is hydraulically actuated, the addition of hydraulic fluid to the cylinder chamber 314 via the hydraulic port 316 allows the roller head assembly 202 to be actuated away from the drill pipe (in addition to accommodating varying diameters of drill pipe), which reduces the occurrence of friction between the rollers 208 and the drill pipe, for example in response to vertical movement of the drill pipe relative to the rollers 208. Additionally, as the OD of the drill pipe increases, the roller head assembly 202, pivotal arms 224, and cylinder clevis 306 may be actuated to move further in the rearward direction 233 (e.g., by adding hydraulic fluid via the hydraulic fluid port 316). Similarly, as the OD decreases, the roller head assembly 202, pivotal arms 224*a*, 224*b*, 224*c*, and 224*d*, and cylinder clevis 306 may be actuated to move in a forward direction 231 (e.g., by removing hydraulic fluid via the hydraulic fluid port 316). This allows drill pipe speed sensor 200 to measure RPM and direction of different OD drill pipes without component modification or substitution. As above, ODs may range from 2¾ inches to 9½ inches, for example.

Regardless of whether a spring actuated drill pipe speed sensor 200 (as in FIGS. 2*a*-2*c*) or a hydraulically actuated drill pipe speed sensor 300 (as in FIGS. 3*a*-3*c*) is employed, examples of this disclosure include a drill pipe speed sensor in which the pivot assembly 204, 302 includes first and second mounting members and a biasing member, in addition to the mounting plates 222 and the pivotal arms 224*a*, 224*b*, 224*c*, 224*d*. The mounting members extend between the mounting plates 222, while the biasing member contacts the mounting members and extends between the mounting members. The first mounting member may be coupled to two of the pivotal arms, while the second mounting member may be coupled to the mounting plates. In one example, the first and second mounting members comprise the spring cups 226*a*, 226*b* and the biasing member comprises the compression spring(s) 230, as described above with respect to FIGS. 2*a*-2*c*. In another example, the first and second mounting members comprise the cylinder clevis 306 and the cylinder mount 308, respectively, and the biasing member comprises the cylinder 304 and piston 310 arrangement, as described above with respect to FIGS. 3*a*-3*c*.

FIG. 4 illustrates drill pipe speed sensor 200 with compression springs 230 in an expanded position (forward position). Although not explicitly shown in FIG. 4, in another example, the compression springs 230 may be replaced with the cylinder 304 and piston 310 arrangement described above, with respect to FIGS. 3*a*-3*c*. As shown, drill pipe 400 has an $OD_1$ that is less than $OD_2$ (shown in FIG. 5). For example, $OD_1$ may be 2¾ inches, whereas, $OD_2$ may be 6⅝ inches. For a smaller $OD_1$, roller head assembly 202 is forced/extended forward (e.g., forward direction 231)

by compression springs 230 due to their expanded position, as shown. In this forward position, rollers 208 are extended forward to contact drill pipe 400. It should be noted that the initial position for roller head assembly 202 is a forward position (i.e., roller head assembly 202 may subsequently be pushed back depending on the OD of the drill pipe). As a drill pipe OD increases, rollers 208 are pushed rearward by the larger OD of the drill pipe, thereby compressing compression springs 230. This allows accommodation of larger OD drill pipes, as shown in FIG. 5, for example. This allows drill pipe speed sensor 200 to measure direction and RPM of larger and smaller OD drill pipes without component modification or substitution.

FIG. 5 illustrates drill pipe speed sensor 200 with compression springs 230 in a compressed position. Although not explicitly shown in FIG. 5, in another example, the compression springs 230 may be replaced with the cylinder 304 and piston 310 arrangement described above, with respect to FIGS. 3*a*-3*c*. As shown, drill pipe 500 has an $OD_2$ that is greater than $OD_1$ (shown in FIG. 4). For example, $OD_2$ may be 9½ inches, whereas, $OD_1$ may be 6⅝ inches. For a larger $OD_2$, roller head assembly 202 is in a retracted position (e.g., rearward direction 233) due to the larger $OD_2$ pushing against rollers 208, thereby forcing compression springs 230 into their compressed position, as shown. As a drill pipe OD increases, rollers 208 are pushed rearward, thereby compressing compression springs 230. This allows accommodation of larger OD drill pipes, as shown in FIG. 5, for example. This allows drill pipe speed sensor 200 to measure direction and RPM of larger and smaller OD drill pipes without component modification or substitution.

FIG. 6 is a side view of drill pipe speed sensor 200 attached to a spinning wrench assembly 600. In some examples, the spinning wrench assembly 600 may be coupled to or otherwise integrated to an iron roughneck, or a pipe column racker. As shown, drill pipe speed sensor 200 is attached to spinning wrench carrier 602 (of assembly 600) via attachment members 604 (e.g., bolts, screws, or rods) that couple mounting plates 222 to carrier 602. Drill pipe speed sensor 200 may be positioned above spinning wrenches 606 (coupled to carrier 602). In another example, drill pipe speed sensor 200 may be positioned below the spinning wrenches 606 in the assembly 600. Regardless of the particular vertical positioning of the drill pipe speed sensor 200, rollers 208 are in contact with drill pipe 608. As spinning wrenches 606 rotate drill pipe 608, rollers 208 rotate along with drill pipe 608, thereby allowing incremental encoder 212 (shown in FIG. 5) to measure direction and RPM of drill pipe 608 and supply this information to system controller 218, as described herein.

Figure 7:
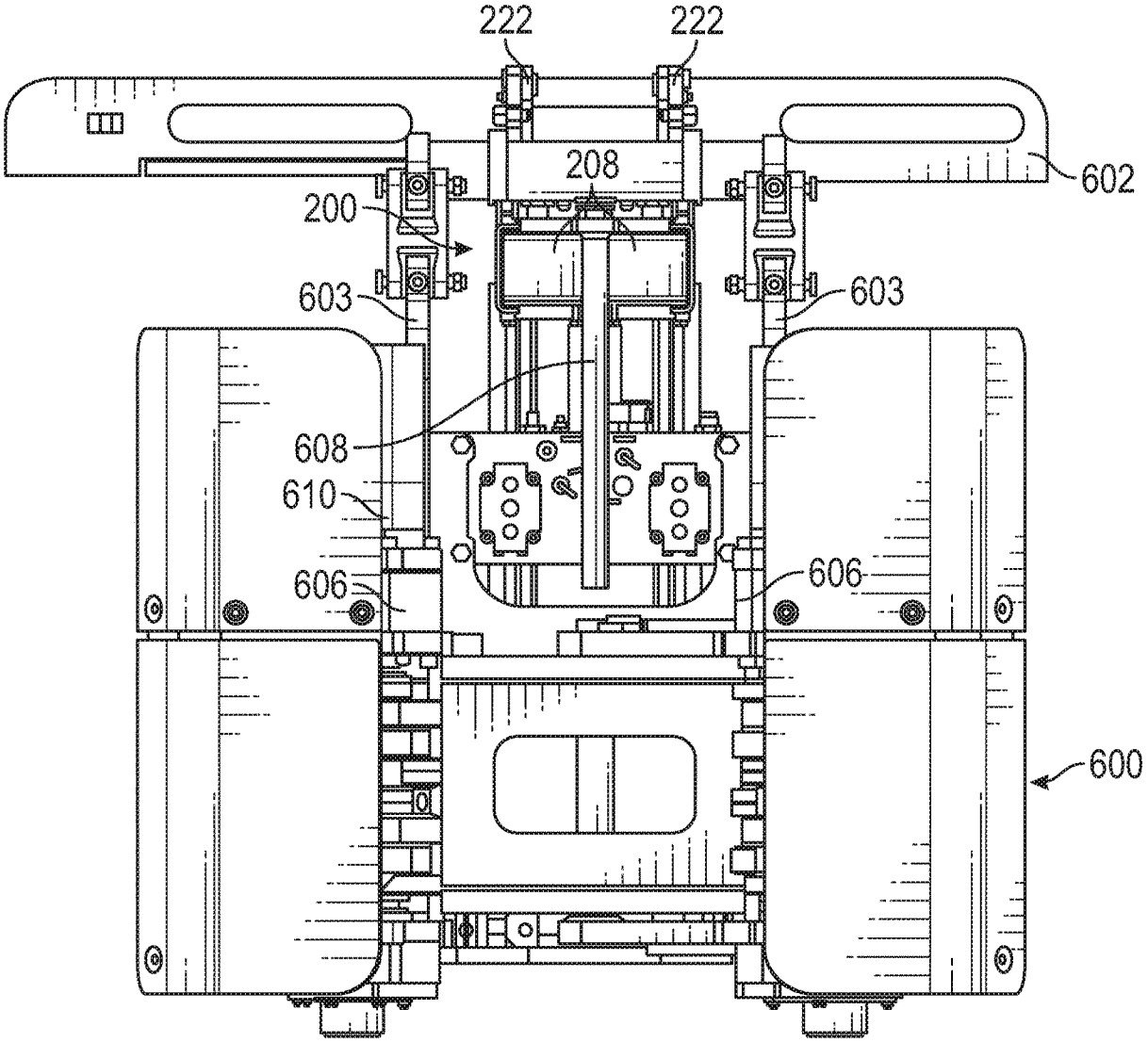
FIG. 7 is a front view of a drill pipe speed sensor attached to a spinning wrench, in accordance with an embodiment of the disclosure.

FIG. 7 is a front view of drill pipe speed sensor 200 as part of the assembly 600, attached to the carrier 602. As shown, drill pipe 608 contacts rollers 208. Spinning wrenches 606 are not in contact with drill pipe 608, as shown in this view; however, when drill pipe 608 is ready to be connected/disconnected to/from another drill pipe, spinning wrenches 606 will close upon (to contact) drill pipe 608 and rotate drill pipe 608.

Figure 8:
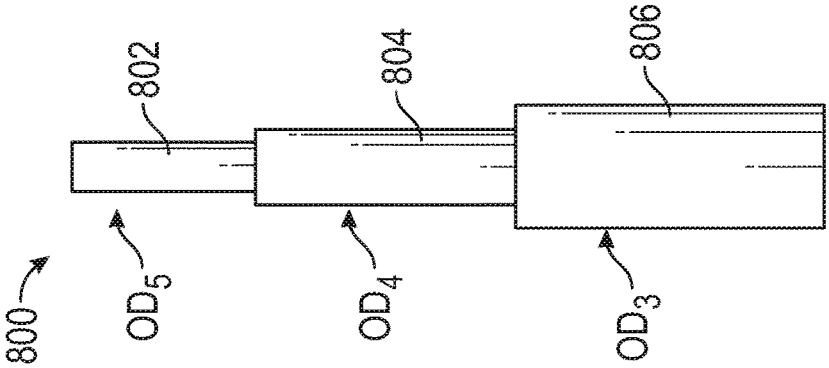
FIG. 8 illustrates a drill string in accordance with an embodiment of the disclosure.

FIG. 8 illustrates drill string 800 including drill pipes 802, 804, and 806. As shown, drill pipes 802, 804, and 806 are of various diameters. That is, $OD_3>OD_4>OD_5$. As described herein, drill pipe speed sensor 200 is configured to determine RPM and direction of drill pipes of different ODs (e.g., drill pipes 802, 804, and 806), without component modification or substitution. For example, when drill string 800 is being assembled (or disassembled) by spinning wrenches coupled to the carrier 602, drill pipe speed sensor 200 is configured to determine RPM and direction of each differently sized drill pipe (e.g., drill pipes 802, 804, and 806). That is, as a drill pipe OD increases, rollers 208 are pushed rearward by the larger OD drill pipe, thereby compressing compression springs 230 (see FIG. 5). Or, as a drill pipe OD decreases, rollers 208 extend forward (to contact a smaller drill pipe OD) due to compression springs 230 expanding in a forward direction (see FIG. 4). In another example, rather than compressing or expanding compression springs 230, the compression springs 230 may be replaced with the cylinder 304 and piston 310 arrangement described above, with respect to FIGS. 3*a*-3*c*. In this example, hydraulic fluid is added to or removed from the cylinder chamber 314 via the hydraulic fluid port 316 to effect the movement of the rollers forward or rearward to accommodate varying drill pipe ODs. In both the spring actuated and hydraulically actuated examples, the drill pipe speed sensor 200 accommodates different sized drill pipes without component modification or substitution due to the adjustability of drill pipe speed sensor 200, as described herein.

Figure 9:
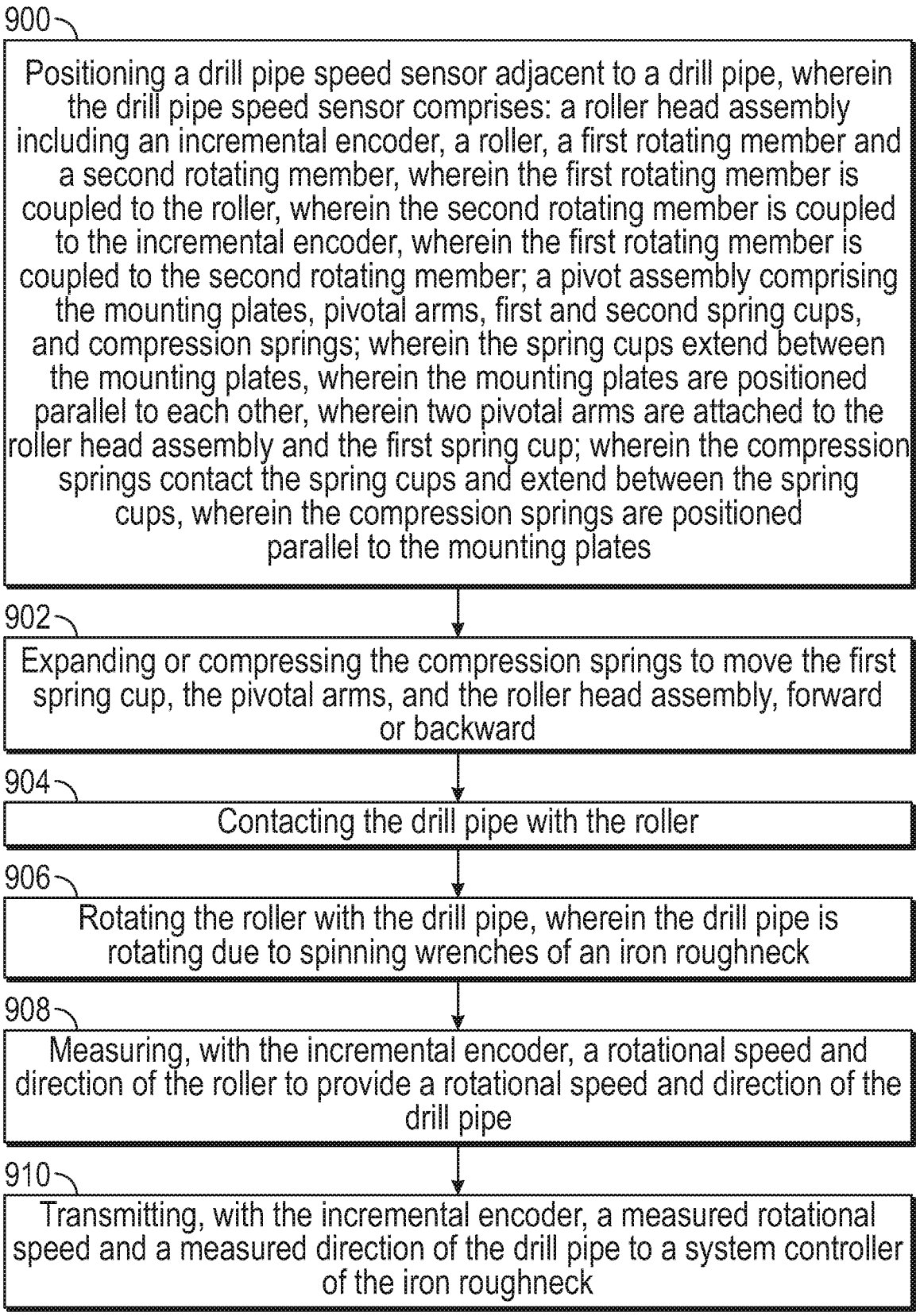
FIG. 9 is a flowchart illustrating steps of operating a drill pipe speed sensor in accordance with an embodiment of the disclosure.

FIG. 9 is a flow chart illustrating steps of operating drill pipe speed sensor 200. Step 900 includes positioning a drill pipe speed sensor 200 adjacent to a drill pipe (e.g., drill pipe 400 or 500), wherein the drill pipe speed sensor 200 comprises: a roller head assembly 202 including an incremental encoder 212, a roller 208, a first rotating member 210, and a second rotating member 214, wherein the first rotating member 210 is coupled to roller 208, wherein the second rotating member 214 is coupled to the incremental encoder 212, wherein the first rotating member 210 is coupled to the second rotating member 214; a pivot assembly 204 comprising the mounting plates 222, pivotal arms 224*a*, 224*b*, 224*c*, 224*d*, first and second mounting members (e.g., spring cups 226*a*, 226*b*; or cylinder clevis 306 and cylinder mount 308), and a biasing member (e.g., compression springs 230 or the cylinder 304 and piston 310); wherein the mounting members extend between the mounting plates 222, wherein the mounting plates 222 are positioned parallel to each other, wherein the pivotal arms 224*a*, 224*b*, 224*c*, 224*d* are attached to the roller head assembly 202 and one of the mounting members; wherein the biasing member contacts the mounting members and extends between the mounting members, wherein the biasing member is positioned parallel to the mounting plates 222.

Step 902 includes expanding or compressing the biasing member to move the one mounting member, pivotal arms 224*a*, 224*b*, 224*c*, 224*d*, and the roller head assembly 202, forward or backward.

Step 904 includes contacting the drill pipe (e.g., drill pipe 400 or 500) with the roller 208.

Step 906 includes rotating roller 208 with the drill pipe (e.g., drill pipe 400 or 500), wherein the drill pipe is rotating.

Step 908 includes measuring, with the incremental encoder 212, a rotational speed and direction of the roller 208 to provide a rotational speed and direction of the drill pipe (e.g., drill pipe 400 or 500).

Step 910 includes transmitting a measured rotational speed and a measured direction of the drill pipe (e.g., drill pipe 400 or 500) to a system controller 218 of spinning wrenches coupled to the carrier 602.

During a connection of a first drill pipe (including a threaded pin, e.g., drill pipe 104, 608) to a second drill pipe (including a threaded box, e.g., drill pipe 106), the pin of the first drill pipe may be inserted into the box of the second drill pipe (e.g., shown in FIGS. 1*a*-1*c*). A system controller (e.g., system controller 218) may direct spinning wrenches 606 to spin out/back spin (rotate counterclockwise/spin-out sequence) until a thread of the pin bumps (i.e., when unscrewing a piece of drill pipe, the thread of the drill pipe ends, and the drill pipe drops one thread pitch due to gravity (e.g., the pin drops into the box)) or the drill pipe has rotated one complete rotation. A spinning wrench carriage transducer (in some examples, coupled or integrated to an iron roughneck) may measure upward travel of the piece of the first drill pipe being processed by the spinning wrench carrier or, in some cases, the iron roughneck, and may indicate a negative delta or negative travel distance of the first drill pipe (when the first drill pipe drops at the end of the thread (thread bump)) and transmit this information to system controller 218.

Once the back spin is complete (i.e., a thread bump or one full rotation), system controller 218 directs spinning wrenches 606 to spin (clockwise) the first drill pipe into the second drill pipe. System controller 218 monitors the rotation of the first drill pipe and compares the rotational speed of the first drill pipe to the actual speed of the spinning wrenches 606.

A successful spin-in occurs when the first drill pipe has spun in by a specific number of pipe turns for a particular OD and thread-type, when shouldered (i.e., there is a predetermined number (stored in system controller 218) of turns for each different OD and thread-type, when shouldered). A successful spin-in is when system controller 218 does not detect: (1) rotational movement of the first drill pipe after the specific number of turns for that thread-type of pipe (e.g., detected via spinning wrench carriage transducer), and (2) flow or movement across the spinning wrenches 606 (stalled) (e.g., system controller 218 controls spinning wrenches 606 and thus monitors movement of spinning wrenches 606).

If the first drill pipe does not spin all the way into the second drill pipe (e.g., stalls), or has not been spun in by an amount of turns/rotations recommended by the drill pipe manufacturer (e.g., at least one turn less than recommended), or is spinning at a reduced RPM (e.g., at least 10%) in comparison to the RPM of the spinning wrenches 606 (e.g., system controller 218 stores a predetermined ratio (based on OD and thread-type of the drill pipe) of RPM of drill pipe 608 to RPM of the spinning wrenches 606: spinning wrenches 606 may spin twice as fast (or half as fast) as drill pipe 606 depending on the OD and thread-type of drill pipe 606; if the actual ratio of RPMs is different than the predetermined ratio, then the drill pipe may be cross-threading), then system controller 218 implements the following remedial actions: spinning wrenches 606 will enter into a dither mode where system controller 218 oscillates the speed of the spinning wrenches 606 (spin-in/clockwise or spin-out/counterclockwise) between 0 and a maximum speed, until system controller 218 detects movement. If this fails, then depending on the amount of turns on the first drill pipe where it was stopped, two alternate actions will occur: (1) if the first drill pipe was more than (this is to be confirmed through on-site field test) 80% spun in, system controller 218 directs spinning wrench motor 610 (of the assembly 600) to complete the connection by actuating spinning wrenches 606 (make-up the drill pipes to achieve shouldered status (via a make-up sequence); or (2) if the first drill pipe was less than 80% spun in, then system controller 218 may cease operation of the spinning wrench assembly 600 and alert an operator. In another example, instead of directing the spinning wrench motor 610 and spinning wrenches 606 to complete the connection, the system controller 218 directs or controls a torque wrench (not shown for simplicity) to couple to the first drill pipe and to rotate or torque the first drill pipe into the second drill pipe to complete the connection.

Upon a successful spin-in (shouldered status), system controller 218 may direct spinning wrench assembly 600 to proceed to the make-up sequence where system controller 218 directs spinning wrench motor 610 (or the torque wrench, not shown for simplicity) to torque the first drill pipe into the second drill pipe. There is a predetermined threshold/set point (stored in system controller 218) for the torqueing of each drill pipe based on thread-type and OD. Once the threshold has been met (e.g., as detected by a pressure sensor coupled to the spinning wrench motor 610 or the torque wrench), system controller 218 directs spinning wrench motor 610 (or the torque wrench) to stop torqueing the first drill pipe into the second drill pipe. Once torqued, system controller 218 initiates a settle timer to allow adequate time to monitor the torque/pressure of the connection. Once the timer is complete, the make-up sequence is deemed complete if the pressure/torque is at the predetermined set point. Otherwise, system controller 218 directs spinning wrench motor 610 (or the torque wrench) to re-stroke/re-torque drill pipe 608 until the predetermined set point has been reached.

During a disconnection (break-out) of a first drill pipe from a second drill pipe, system controller 218 monitors torque applied to the drill pipes by spinning wrench motor 610 or the torque wrench (during a stroke). As explained above, the torque applied may be monitored by a pressure sensor, which is also not shown for simplicity, coupled to the spinning wrench motor 610 or the torque wrench. If the torque drops below a maximum torque that can be generated by the spinning wrenches 606 (plus a comfort factor: e.g., 10% above or below a set point), then spinning wrench assembly 600 will initiate the spin-out sequence, see FIG. 11. If the torque is equivalent to or greater than the maximum torque capability of the spinning wrenches 606, then system controller 218 directs spinning wrenches 606 or the torque wrench to unclamp (from drill pipe 608), reposition for a second stroke to torque drill pipe 608), re-clamp, and make a second attempt to break the connection (re-stroke). This will continue until the torque drops below the threshold torque (e.g., maximum torque capability—this is variable and may be adjusted by system controller 218) for spinning wrenches 606. Once spinning wrenches 606 or the torque wrench successfully completes the break-out, per the above logic, then system controller 218 directs spinning wrenches 606 to start spinning (spin out/counterclockwise) as spinning wrenches 606 close upon drill pipe 608. Once closed on drill pipe 608, drill pipe 608 immediately starts spinning. If drill pipe 608 does not spin, or isn't spinning at the rate as expected by the speed of the spinning wrenches 606, then system controller 218 will implement the following remedial actions: (1) Spinning wrenches 606 enter a dither mode, where system controller 218 oscillates (clockwise or counterclockwise) the RPM of spinning wrenches 606 between 0% and 100% (of the maximum speed) in an attempt to rotate drill pipe 608. At the same time, spinning wrenches 606 or the torque wrench moves to a center position of spinning wrench assembly 600 ready to take another attempt at breaking the connection (re-stroke); (2) If after 5 attempts at "dithering" the connection and drill pipe 608 has not rotated, then spinning wrenches 606 or the torque wrench will close upon drill pipe 608 to break the connection; (3) Spinning wrenches 606 or the torque wrench will then re-open and the spinning wrenches 606 or the torque wrench will attempt to spin drill pipe 608 again; (4) This sequence of attempts will continue until the connection is completely broken or the operator intervenes. System controller 218 reports/records failed or delayed breakouts.

A successful break-out may be recognized by the following: (1) drill pipe 608 has spun the required number of turns for that pipe thread type, such that a pin (e.g., pin 102 shown in FIG. 1*a*) of drill pipe 608 is not interlocked with a box (e.g., box 100) of a second drill pipe (e.g., drill pipe 106) and is sitting at the very top of a thread of the box of the second drill pipe ("thread jump"); or (2) drill pipe 608 has spun the required number of turns for that pipe thread type (and OD) and system controller 218 detects that drill pipe 608 has thread jumped by way of looking at a velocity profile of the spinning wrench carriage transducer.

Figure 10:
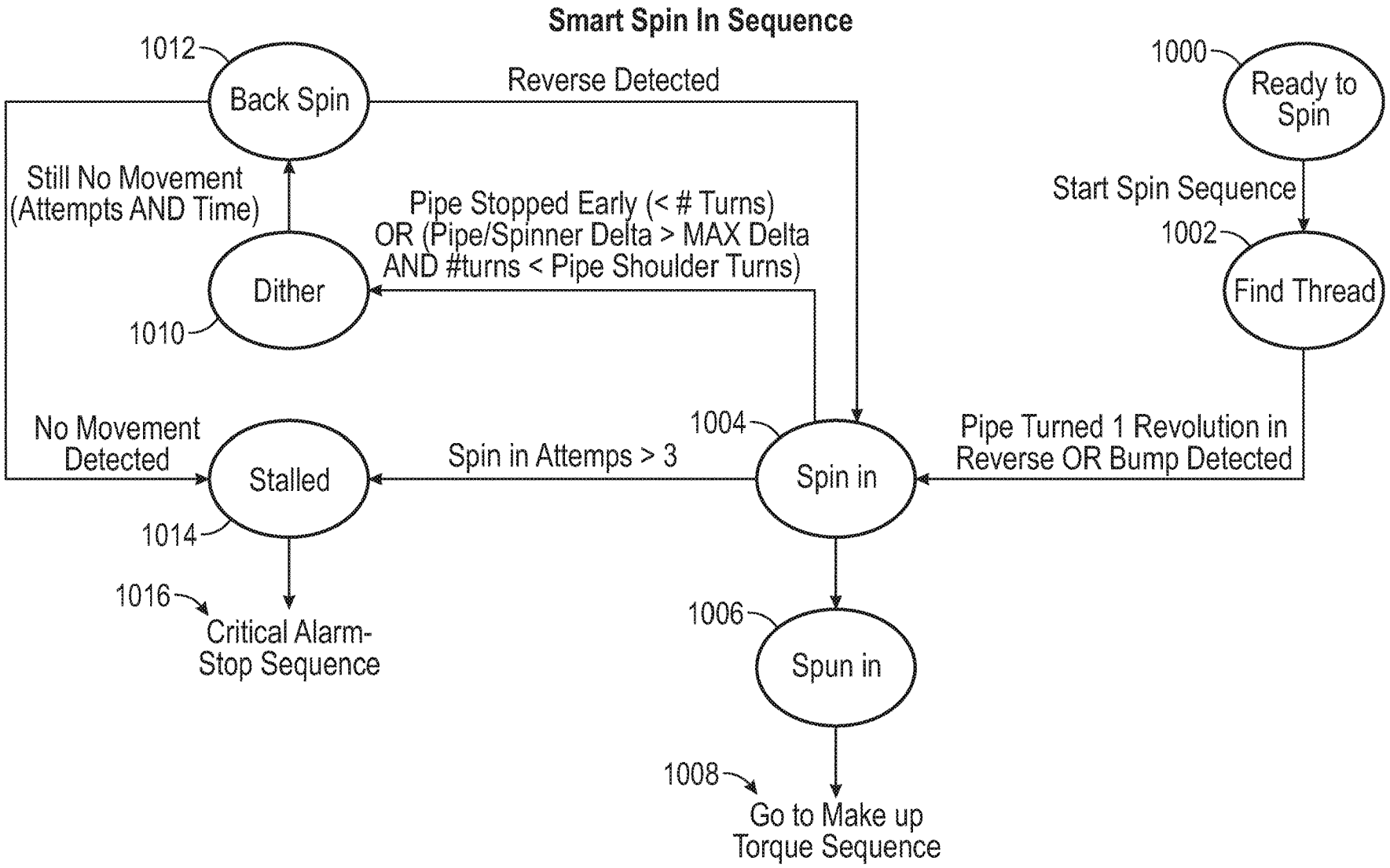
FIG. 10 is a flowchart illustrating steps of a spin-in sequence, in accordance with an embodiment of the disclosure.

FIG. 10 is a flow chart illustrating a spin-in sequence. At step 1000, system controller 218 is ready to rotate spinning wrenches 606 (clockwise) to spin in drill pipe 608 into a second drill pipe. At step 1002, system controller 218 directs spinning wrenches 606 to rotate drill pipe 608 one complete revolution in reverse (counterclockwise) or detects a thread bump. At step 1004, system controller 218 directs spinning wrenches 606 to spin drill pipe 608 into a second drill pipe (e.g., drill pipe 106) (spin in). At step 1006, spin-in of drill pipe 608 into the second drill pipe is achieved (shouldered status). Next step 1008 is to enter a make-up sequence (see FIG. 12).

If the spin-in is unsuccessful (e.g., drill pipe 608 stopped early (drill pipe 608 did not rotate the predetermined amount of turns for that specific thread-type and OD); or the difference between the RPMs of the spinning wrenches 606 and drill pipe 608 is greater than a predetermined threshold and the number of turns of drill pipe 608 is less than the predetermined number of turns for that specific thread-type and OD), then spin in sequence enters a dither mode (as described herein), at step 1010. During dither mode, system controller 218 directs spinning wrenches 606 to backspin (counterclockwise) drill pipe 608 at step 1012, or directs spinning wrenches 606 to spin in (clockwise) drill pipe 608 at step 1004 to unstick drill pipe 608. If system controller 218 does not detect any rotational movement of drill pipe 608, system controller 218 determines that drill pipe 608 is stalled/stuck (e.g., cross-threaded status), stops dithering, at step 1014, and initiates an alarm (e.g., audio, visual) at step 1016.

Figure 11:
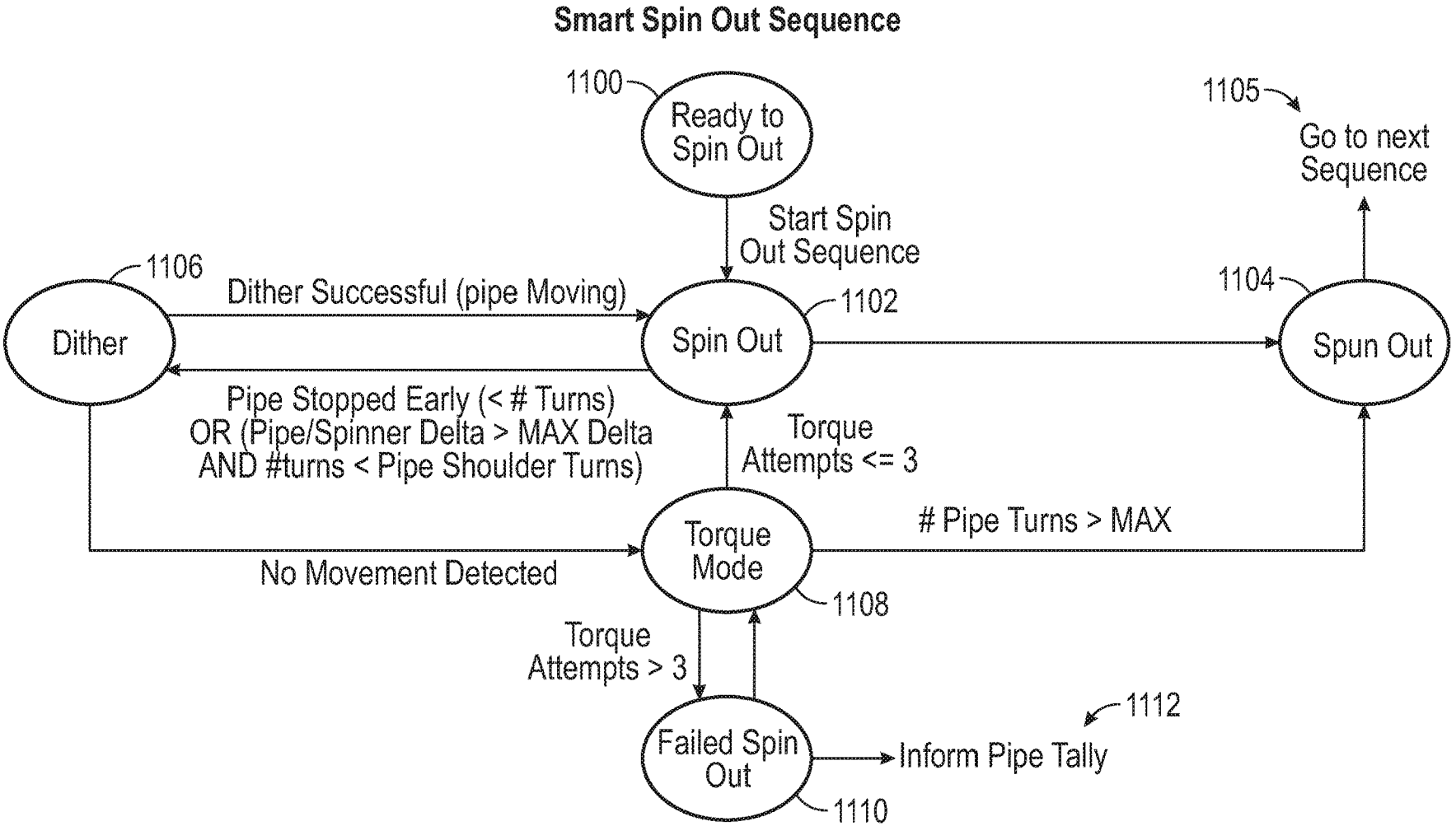
FIG. 11 is a flowchart illustrating steps of a spin-out sequence, in accordance with an embodiment of the disclosure.
Figure 13:
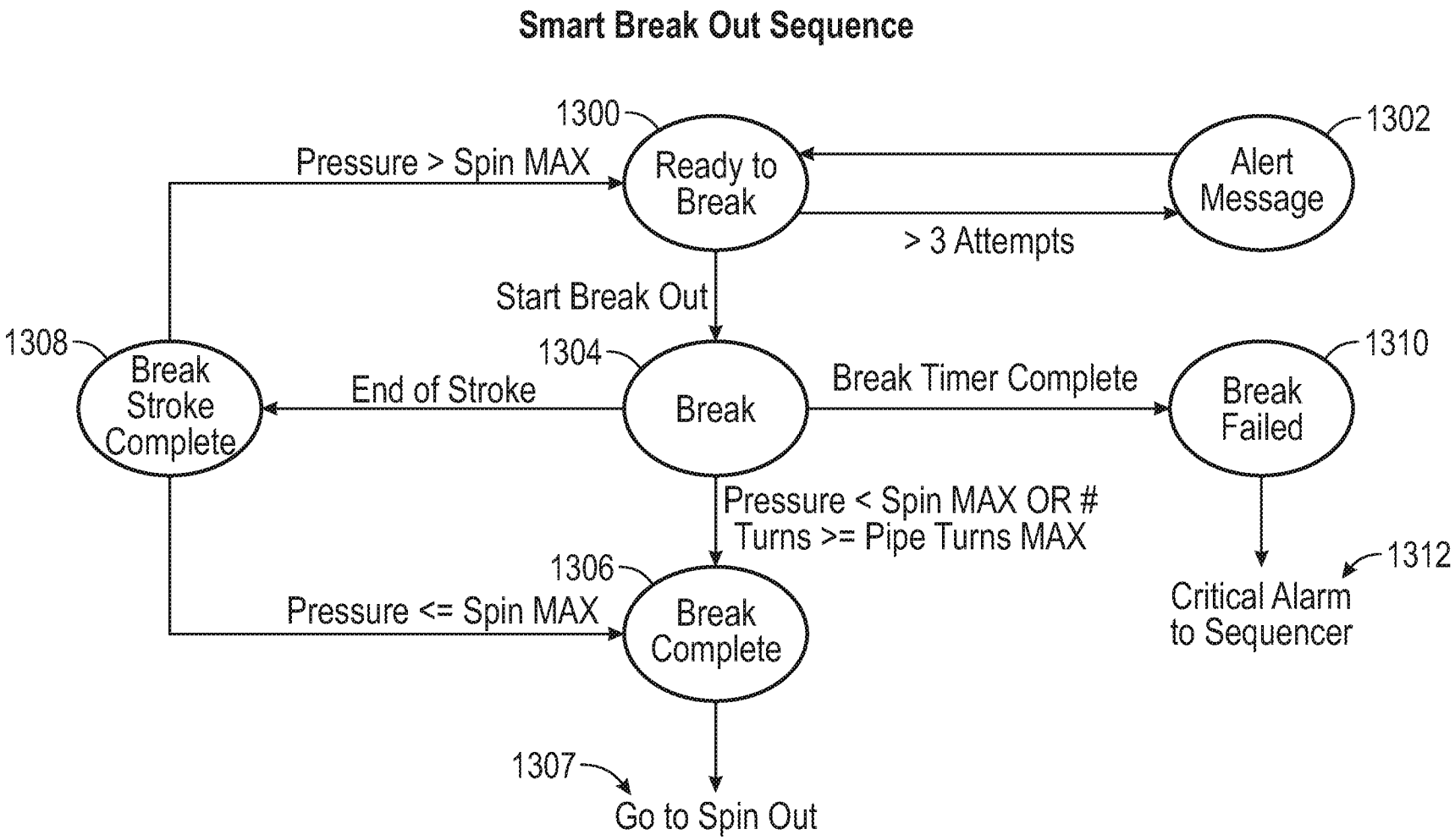
FIG. 13 is a flowchart illustrating steps of a break-out sequence, in accordance with an embodiment of the disclosure.

FIG. 11 is a flow chart illustrating a spin-out sequence (after a break-out sequence, see FIG. 13). At step 1100, system controller 218 is ready to rotate spinning wrenches 606 (counterclockwise) to spin out drill pipe 608 from a second drill pipe. At step 1102, system controller 218 directs spinning wrenches 606 to rotate drill pipe 608 counterclockwise until the thread jumps, as set forth above. If the thread jumps, then at step 1104, system controller detects that drill pipe 608 has been spun out (disconnected/unlocked) from the second drill pipe. At step 1105, system controller 218 may direct another break out sequence for another set of connected drill pipes.

If the spin-out is unsuccessful (e.g., drill pipe 608 stopped early (drill pipe 608 did not rotate the predetermined amount of turns for that specific thread-type and OD); or the difference between the RPMs of the spinning wrenches 606 and drill pipe 608 is greater than a predetermined threshold and the number of turns of drill pipe 608 is less than the predetermined number of turns for that specific thread-type and OD), then spin in sequence enters a dither mode, at step 1106. During dither mode, system controller 218 directs spinning wrenches 606 to backspin (counterclockwise) drill pipe 608, or directs spinning wrenches 606 to spin in (clockwise) drill pipe 608 to unstick drill pipe 608 from the second drill pipe. If system controller 218 does not detect any rotational movement of drill pipe 608, system controller 218 determines that drill pipe 608 is stalled/stuck (e.g., cross-threaded status) in the second drill pipe, stops dithering, and enters a torque mode, at step 1108. At step 1108, system controller 218 directs spinning wrenches 606 or the torque wrench to clamp onto drill pipe 608 and rotate drill pipe 608 counterclockwise to break drill pipe 608 free from the second drill pipe. Once broken free, system controller 218 may direct the torque wrench to release drill pipe 608 and direct spinning wrenches 606 to backspin (counterclockwise) drill pipe 608 out of the second drill pipe, at step 1102, until the thread jumps, at step 1104. System controller 218 may attempt to break drill pipe 608 free from the second drill pipe, with spinning wrench motor 610 or the torque wrench, more than 3 times. If after 4 attempts, the break-out is unsuccessful, system controller 218 determines that a spin-out has failed, at step 1110. At step 1112, system controller 218 may inform an operator and/or a pipe tally of the failed spin-out.

Figure 12:
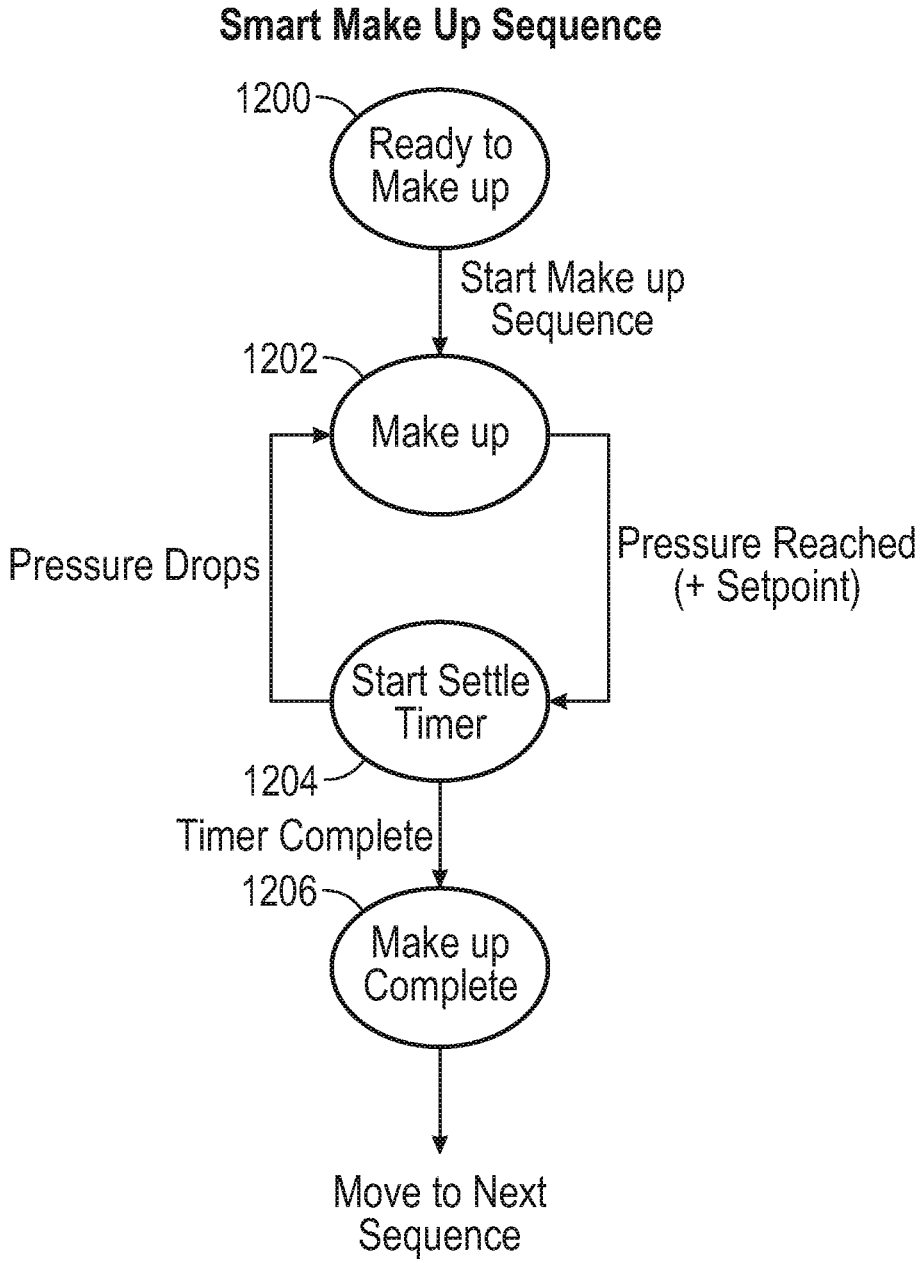
FIG. 12 is a flowchart illustrating steps of a make-up sequence, in accordance with an embodiment of the disclosure.

FIG. 12 illustrates a flow chart of a make-up sequence after a successful spin-in sequence (see FIG. 10). At step 1200, system controller 218 is ready to make up (torque) drill pipe 608 into a second drill pipe (e.g., drill pipe 106) with spinning wrench motor 610 or the torque wrench. At step 1202, system controller 218 directs spinning wrench motor 610 or the torque wrench to torque/rotate drill pipe 608 into the second drill pipe to a predetermined torque/pressure value based on the OD and thread-type of drill pipe 608. At step 1204, after the torqueing of drill pipe 608 into the second drill pipe, system controller 218 initiates a settle timer (e.g., internal component of system controller 218). During this settling time (spinning wrenches 606 or the torque wrench is still clamped to drill pipe 608), system controller 218 monitors if the pressure/torque applied to drill pipe 608 decreases below the predetermined threshold/set point. If the pressure does not decrease and remains at the predetermined set point during this settling time (e.g., 15 seconds), then system controller 218 determines that the make-up is successful and complete, at step 1206. If the pressure decreases below the predetermined set point during the settling time, then system controller 218 determines that the make-up is incomplete/unsuccessful, and directs spinning wrench motor 610 or the torque wrench to torque drill pipe 608 until the make-up is successful/complete.

FIG. 13 illustrates a flow chart of a break-out sequence (before a spin-out sequence, see FIG. 11). At step 1300, system controller 218 is ready to break drill pipe 608 free from a second drill pipe (e.g., drill pipe 106, shown in FIG. 1*a*) with spinning wrench motor 610 or the torque wrench. If system controller 218 is not ready to break drill pipe 608 free after 5 attempts, then system controller 218 initiates/provides an alert message (e.g., audio and/or visual), at step 1302. If system controller 218 is ready to initiate the break-out sequence, then system controller 218 directs spinning wrench motor 610 or the torque wrench to break/torque drill pipe 608 free (counterclockwise) from the second drill pipe at step 1304. If the thread jumps, then the break is successful/complete, at step 1306. Once the break-out is successful/complete, then system controller may initiate the spin-out sequence, at step 1307 (see FIG. 11). After completion of a stroke by spinning wrench motor 610 or the torque wrench, at step 1308: if the torque applied is equivalent to or greater than the maximum torque capability of the spinning wrenches 606, then system controller 218 directs spinning wrenches 606 or the torque wrench to unclamp (from drill pipe 608), reposition for a second stroke to torque drill pipe 608, re-clamp and make a second attempt (re-stroke) to break the connection. This will continue until the torque drops below the threshold torque (e.g., maximum torque capability—this is variable and may be adjusted by system controller 218) for spinning wrenches 606. If the break out does not occur after a predetermined time period set by system controller 218, system controller 218 determines that the break-out sequence has failed and drill pipe 608 has not been disconnected from the second drill pipe, at step 1310. If the break-out has failed, system controller 218 initiates/provides an alarm (e.g., audio and/or visual) indicating this failure, at step 1312.

The particular embodiments disclosed above are illustrative only, as the embodiments may be modified and practiced in different manners apparent to those skilled in the art having the benefit of the teachings herein. It is therefore evident that the particular embodiments disclosed above may be altered or modified and all such variations are considered within the scope of the present disclosure.

What is claimed is:

1. A drill pipe speed sensor comprising:

a roller head assembly including an incremental encoder, a roller configured to contact a drill pipe, a first rotating member, and a second rotating member, wherein the first rotating member is coupled to the roller, wherein the second rotating member is coupled to the incremental encoder, wherein the first rotating member is rotatably coupled to the second rotating member;

a pivot assembly comprising mounting plates, pivotal arms, a first mounting member, a second mounting member, and a biasing member;

wherein the first and second mounting members extend between the mounting plates, wherein the mounting plates are parallel to each other;

wherein the biasing member contacts the mounting members and extends between the mounting members, wherein the biasing member is parallel to the mounting plates;

wherein the pivotal arms extend from the mounting plates to the roller head assembly and pivot relative to the mounting plates, wherein the first mounting member is coupled to two of the pivotal arms.

2. The drill pipe speed sensor of claim 1, wherein the mounting plates are coupled to a spinning wrench carrier, wherein the first rotating member is coupled to the second rotating member with a belt or chain.

3. The drill pipe speed sensor of claim 2, wherein the incremental encoder is configured to determine rotational speed and direction of the roller and transmit the rotational speed to a system controller of the spinning wrench carrier.

4. The drill pipe speed sensor of claim 1, wherein the first and second mounting members comprise spring cups and the biasing member comprises a compression spring.

5. The drill pipe speed sensor of claim 4, wherein the compression spring is configured to move the first spring cup, the pivotal arms, and the roller head assembly in a forward direction or a rearward direction to contact the drill pipe.

6. The drill pipe speed sensor of claim 4, further comprising an alignment rod positioned between the spring cups and extending through the compression spring, wherein the alignment rod aligns the spring cups with each other.

7. The drill pipe speed sensor of claim 4, wherein the second spring cup is coupled to the mounting plates.

8. The drill pipe speed sensor of claim 1, wherein the first mounting member comprises a cylinder clevis, the second mounting member comprises a cylinder mount, and the biasing member comprises a cylinder and piston arrangement.

9. The drill pipe speed sensor of claim 8, wherein the cylinder and piston arrangement is configured to move the cylinder clevis, the pivotal arms, and the roller head assembly in a forward direction or a rearward direction to contact the drill pipe.

10. The drill pipe sped sensor of claim 8, wherein the cylinder and piston arrangement further comprises:

a piston head configured to move within a cylinder chamber;

a hydraulic fluid port coupled to the cylinder chamber on a first side of the piston head; and a pressurized gas port coupled to the cylinder chamber on a second side of the piston head.

11. The drill pipe speed sensor of claim 1, wherein the roller is configured to rotate about a vertical axis upon contact with a rotating drill pipe.

12. The drill pipe speed sensor of claim 1, wherein the drill pipe speed sensor is positioned above spinning wrenches of an iron rough neck.

13. A drill pipe speed sensor, comprising:

a roller head assembly including an incremental encoder, a first rotating member, a second rotating member, and a roller configured to contact a drill pipe of a drill string during rotation of the drill pipe, wherein the drill string comprises a plurality of drill pipes with different outer diameters, wherein the first rotating member is coupled to the roller, wherein the second rotating member is coupled to the incremental encoder, wherein the first rotating member is rotatably coupled to the second rotating member;

a pivot assembly comprising mounting plates, pivotal arms, a first mounting member, a second mounting member, and a biasing member;

wherein the first and second mounting members extend between the mounting plates, wherein the mounting plates are parallel to each other;

wherein the biasing member contacts the mounting members and extends between the mounting members, wherein the biasing member is parallel to the mounting plates;

wherein the pivotal arms extend from the mounting plates to the roller head assembly and pivot relative to the mounting plates, wherein the first mounting member is coupled to two of the pivotal arms;

wherein the biasing member is configured to move the roller head assembly in a forward or rearward direction to allow contact between each of the drill pipes with different outer diameters and the roller;

wherein the incremental encoder is configured to determine rotational speed and direction of the roller and transmit the rotational speed and direction to a system controller of a spinning wrench carrier.

14. The drill pipe speed sensor of claim 13, wherein the mounting plates are configured to attach to a frame of the spinning wrench carrier.

15. The drill pipe speed sensor of claim 13, wherein the first and second mounting members comprise spring cups and the biasing member comprises a compression spring.

16. The drill pipe speed sensor of claim 15, wherein the second spring cup is coupled to the mounting plates, wherein the first rotating member is coupled to the second rotating member with a belt or chain.

17. The drill pipe speed sensor of claim 15, further comprising an alignment rod positioned between the spring cups and extending through the compression spring, wherein the alignment rod aligns the spring cups with each other.

18. The drill pipe speed sensor of claim 15, wherein the compression spring is configured to move the first spring cup and the pivotal arms in the forward direction or the rearward direction to allow contact between each of the drill pipes with different outer diameters and the roller.

19. The drill pipe speed sensor of claim 13, wherein the drill pipe speed sensor is positioned above spinning wrenches of the spinning wrench carrier.

20. The drill pipe speed sensor of claim 13, wherein the roller is configured to rotate about a vertical axis upon contact with a rotating drill pipe.

21. A method for determining a rotational speed and direction of a drill pipe, comprising:

positioning a drill pipe speed sensor adjacent to a drill pipe, wherein the drill pipe speed sensor comprises:

a roller head assembly including an incremental encoder, a roller, a first rotating member and a second rotating member, wherein the first rotating member is coupled to the roller, wherein the second rotating member is coupled to the incremental encoder, wherein the first rotating member is rotatably coupled to the second rotating member;

a pivot assembly comprising mounting plates, pivotal arms, a first mounting member, a second mounting member, and a biasing member;

wherein the first and second mounting members extend between the mounting plates, wherein the mounting plates are parallel to each other, wherein two of the pivotal arms are attached to the roller head assembly and the first mounting member;

wherein the biasing member contacts the mounting members and extends between the mounting members, wherein the biasing member is parallel to the mounting plates;

expanding or compressing the biasing member to move the first mounting member, the pivotal arms, and the roller head assembly, forward or backward;

contacting the drill pipe with the roller;

rotating the roller with the drill pipe, wherein the drill pipe is rotating due to spinning wrenches of a spinning wrench carrier; and measuring, with the incremental encoder, a rotational speed and direction of the roller to provide the rotational speed and direction of the drill pipe.

22. The method of claim 21, further comprising transmitting a measured rotational speed and a measured direction of the drill pipe to a system controller of the spinning wrench carrier, wherein the first rotating member is coupled to the second rotating member with a belt or chain.

23. The method of claim 22, further comprising comparing the rotational speed of the drill pipe to a rotational speed of the spinning wrenches.

24. The method of claim 23, further comprising rotating the drill pipe with a spinning wrench motor of the spinning wrench carrier, based on a comparison of the rotational speed of the drill pipe to the rotational speed of the spinning wrenches.

25. The method of claim 21, wherein positioning the drill pipe speed sensor adjacent to the drill pipe comprises positioning the drill pipe speed sensor above the spinning wrenches of the spinning wrench carrier.

* * * * *